US007681969B2

(12) United States Patent
Hamakawa et al.

(10) Patent No.: US 7,681,969 B2
(45) Date of Patent: Mar. 23, 2010

(54) LIQUID EJECTION APPARATUS

(75) Inventors: Hiroshi Hamakawa, Nagano-ken (JP); Kazuhisa Takeda, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 12/316,700

(22) Filed: Dec. 16, 2008

(65) Prior Publication Data

US 2009/0135216 A1 May 28, 2009

Related U.S. Application Data

(62) Division of application No. 11/060,369, filed on Feb. 16, 2005, now Pat. No. 7,481,527.

(30) Foreign Application Priority Data

Feb. 17, 2004 (JP) ..... 2004-039148
Jun. 30, 2004 (JP) ..... 2004-192676
Jun. 30, 2004 (JP) ..... 2004-193599

(51) Int. Cl.
*B41J 25/308* (2006.01)

(52) U.S. Cl. ..... 347/8; 347/104; 347/101

(58) Field of Classification Search ..... 347/5, 347/8, 9, 101, 103, 104
See application file for complete search history.

(56) References Cited

U.S. PATENT DOCUMENTS 5,852,452 A * 12/1998 Imai ..... 347/8
6,059,287 A 5/2000 Bae
6,273,536 B1 * 8/2001 Nozawa ..... 347/8
6,315,468 B2 11/2001 Kishida et al.

FOREIGN PATENT DOCUMENTS

| | | |
|---|---|---|
| JP | 10-211748 | 8/1998 |
| JP | 2000037916 A | 2/2000 |
| JP | 2002-019204 | 1/2002 |
| JP | 2002-248819 | 9/2002 |
| JP | 2002-347304 | 12/2002 |
| JP | 2003063095 A | 3/2003 |
| JP | 2004160844 A | 6/2004 |

* cited by examiner

*Primary Examiner*—Lam S Nguyen
(74) *Attorney, Agent, or Firm*—Nutter McClennen & Fish LLP; John J. Penny, Jr.; Rory P. Pheiffer

(57) ABSTRACT

A liquid ejection apparatus for discharging a medium on which liquid is ejected by a discharge roller after ejecting liquid on the medium by a liquid ejection head includes a medium pressing roller for controlling floatation of the medium between the liquid ejection head and the discharge roller, the medium pressing roller being provided on a rotatable discharge frame, wherein the liquid ejection apparatus operates by switching between a first mode where the medium pressing roller moves to an upper position by rotation of the discharge frame and a second mode where the medium pressing roller moves to a lower position than the first mode to press the medium downward.

6 Claims, 19 Drawing Sheets

LIQUID EJECTION APPARATUS

This application is a divisional of U.S. patent application Ser. No. 11/060,369, filed Feb. 16, 2005, issued U.S. Pat. No. 7,481,527, which claims priority to JP 2004-039148 filed on Feb. 17, 2004, JP 2004-193599 filed on Jun. 30, 2004 and JP 2004-192676 filed on Jun. 30, 2004. The contents of each of these applications are incorporated herein by this reference in their entirety.

BACKGROUND OF THE INVENTION

1. Field of the Invention

The present invention relates to a liquid ejection apparatus such as an ink-jet recording apparatus for ejecting a liquid such as ink ejecting from a head thereof on a medium (herein after, referred to "recording medium").

Here, the liquid ejection apparatus is not limited to a printer, a copying machine, a facsimile, etc., using a recoding head for recording on a recording medium by ink ejecting from the head. The liquid ejection apparatus includes an apparatus for ejecting a fluid which may be used instead of the ink from a fluid ejection head corresponding to the recording head on a recording medium corresponding to the recording medium.

The fluid ejection head includes a colorant ejection head used for manufacturing a color filter of a liquid crystal display, an electrode material (conductive paste) ejection head used for forming electrodes of an organic EL display, a field emission display (FED), etc., and a bio-organic substance ejection head used for manufacturing a bio chip, a sample material ejection head such as a precision pipette, etc., in addition to the recording head.

2. Description of the Related Art

There is an ink-jet printer (herein after, referred to "printer") as an example of the liquid ejection apparatus or the recording apparatus. The printer is provided with a guiding member (which may be called "platen") at a position opposite to the recording head for ejecting ink drops to a printing paper which is an example of the recording medium or the recording medium, wherein the guiding member predetermines a distance between the printing paper and the recording head. The guiding member extends in the main scanning direction of the recording head and predetermines the distance between the printing paper and the recording head by supporting the printing paper from the underside.

A transfer (paper transfer) roller for transferring the printing paper to the side of the recording head is provided upstream of the guiding member and a discharge (paper discharge) roller for discharging the recorded printing paper is provided downstream of the guiding member. The transfer roller includes a driving transfer roller which is formed by a shaft extending in the width direction of the printing paper and drives rotation and a driven transfer roller which is adjacent to and rotates following the driving transfer roller. Moreover, the discharge roller includes: a driving discharge roller which is localized on a rotation axis extending in the width direction of the printing paper and drives rotation; and a driven discharge roller which is adjacent to and rotates following the driving discharge roller. The driven discharge roller is provided so that it is localized on a driven discharge roller supporting frame of a shape extending in the direction of the main scanning direction of the recording head in the direction of the main scanning direction.

Japanese Patent Application Laid Open No. 2002-19204 discloses a paper transfer apparatus of a recording apparatus in which a vertex of a platen is lower than a line connecting a nip point of a paper transfer roller and a nip point of a paper discharge roller and the paper transfer speed of the paper transfer roller is the same as the paper discharge speed of the paper discharge roller and which performs printing with a good quality even after the end of a paper gets out of the paper transferring roller.

Japanese Patent Application Laid Open No. 2002-248819 discloses restricting the position of a platen in the direction opposite to a recording head of the platen by the planet's colliding with a restricting means by an energizing force of an energizing means and consequently determining a platen gap.

Japanese Patent Application Laid Open No. 1998-211748 discloses moving a gap regulating unit on a shaft of a paper discharge roller driven by a paper transfer motor to the side of engaging with a middle gear by shifting to a platen gap switching position of a carriage, engaging one side of a planet gear with the middle gear according to a rotational direction of the paper transfer motor, rotating a pair of guide rods in the same directions and by the same amounts through a sector gear according to the rotational direction, and shifting a carriage parallel to a printing reference plane.

Each of Japanese Patent Application Laid Open Nos. 2002-19204 and 1998-211748 discloses an apparatus having a function of switching the height of a recording head in order to prevent the rear end of a paper from floating, which makes the configuration of the apparatus complicated because the apparatus should include means for moving a carriage mechanism in the vertical direction. Moreover, Japanese Patent Application Laid Open No. 2002-248819 discloses an apparatus having function of translating a platen in the vertical direction in order to prevent a recording medium for contacting with a recording head, and a constitution performing the function is also complicated.

The elements such as the guiding member, the driving transfer roller, the driving discharge roller, and the driven discharge roller supporting frame described above are installed on a frame material forming the body of the printer like a sub-frame disclosed in Japanese Patent Application Laid Open No. 2002-347304.

However, in case the plurality of elements are installed on one frame material, the elements need to be installed sequentially which is not effective.

Moreover, the frame material is generally made of metal in order to acquire strength and the guiding member is sometimes made of resin because of complexity of its shape and construction. In this case, due to the difference in the rate of thermal expansion between the both, a shear stress is generated in the guiding member and thus the guiding member is deformed. In this case, there is a problem that the distance between the printing paper and the recording head (which may be called "platen gap") is not uniform and thus quality of recording gets worse. These kinds of problems may be caused by low initial precision of components in addition to the temperature variation. Furthermore, if the driven discharge roller supporting frame is fixed to the frame material by a screw, warpage is generated due to the size change as time goes by and thus a shear stress is generated in the driven discharge roller supporting frame. Thus, similarly with the guiding member, there is a problem that the driven discharge roller supporting frame may also be deformed. If the driven discharge roller supporting frame is deformed, the position of the driven discharge roller is varied. By this, the driven discharge roller contacts the printing paper strongly and there is a problem that contact traces are formed on the printing surface.

SUMMARY OF THE INVENTION

Therefore, it is an object of the present invention to provide a fluid ejection apparatus which can prevent the rear end of a paper from contacting with a fluid ejection head by preventing the rear end of a paper from floating with a relatively simple configuration.

Moreover, it is another object of the present invention to provide the fluid ejection apparatus which can adjust a medium gap by bending a transfer path a little with a relatively simple configuration in order to prevent the rear end of the paper from contacting with the liquid ejection head or adjust the medium gap without moving the liquid ejection head.

Furthermore, it is another object of the present invention to provide the fluid ejection apparatus which can improve assembling efficiency and prevent deformation of members due to a difference in rate of thermal expansion and warpage generated by the size change.

The above and other objects can be achieved by combinations described in the independent claims. The dependent claims define further advantageous and exemplary combinations of the present invention.

According to the first aspect of the present invention, a liquid ejection apparatus for discharging a medium on which liquid is ejected by a discharge roller after ejecting liquid on the medium by a liquid ejection head includes a medium pressing roller for controlling floatation of the medium between the liquid ejection head and the discharge roller, the medium pressing roller being provided on a rotatable discharge frame, wherein the liquid ejection apparatus operates by switching between a first mode where the medium pressing roller moves to an upper position by rotation of the discharge frame and a second mode where the medium pressing roller moves to a lower position than the first mode to press the medium downward.

According to the first aspect of the present invention, it is possible to prevent the rear end of the recording medium for contacting with the liquid ejection head by pressing down the rear end of the recording medium by the medium pressing roller in case the rear end of the recording medium floats upward and thus contacts with the liquid ejection head during discharging the recording medium on which the liquid is ejected.

According to the second aspect of the present invention, the liquid ejection apparatus of the first aspect further includes a first rotating member rotatable about an axis in a main scanning direction on a position facing with the liquid ejection head, a surface facing the liquid ejection head forming a transfer path; and a second rotating member rotatably connected to the first rotating member via a connecting unit, the second rotating member forming the transfer path and being rotatable about an axis in the main scanning direction, wherein the first and second rotating members vary a gap between the liquid ejection head and the surface of the first rotating member facing with the liquid ejection head by rotating in opposite directions and bending on the connecting unit.

According to the second aspect of the present invention, the transfer path is formed by the first and second rotating members rotatably connected via the connecting unit. Thus, it is possible to form a small recess on the transfer path by bending it on a part of the connecting unit. As a result, it is possible to increase or decrease a gap between the surface of the first rotating member facing the liquid ejection member and the liquid ejection member, that is, a medium gap by forming small recess on the transfer path the without moving the liquid ejection head. Thus, in case there is a problem that the rear end of the recording medium floats and thus contacts with the liquid election head or the recording medium is thick, it is possible to overcome the problem by enlarging the medium gap. Moreover, since the recess due to the bending of the transfer path is very small, the smooth transfer of the recording medium is not disturbed.

According to the third aspect of the present invention, a platen of a platen unit rotating with the first rotating member is provided on a position facing with the liquid ejection head, and the platen unit varies a gap between the platen and the liquid ejection head by rotating in a direction opposite to a direction in which the discharge frame rotates in association with rotation of the discharge frame into the second mode.

According to the third aspect of the present invention, the platen unit rotates to move downward in association with the rotation of the discharge frame. As a result, the gap between the platen and the liquid ejection head, that is, a medium gap is enlarged by switching the mode without moving the liquid ejection head and thus there is not a problem that the rear end of the recording medium contacts with the liquid ejection nozzle.

According to the forth aspect of the present invention, a liquid ejection apparatus for discharging a medium on which liquid is ejected by a discharge roller after ejecting liquid on the medium by a liquid ejection head includes a first rotating member rotatable about an axis in a main scanning direction on a position facing with the liquid ejection head, a surface facing the liquid ejection head forming a transfer path; and a second rotating member rotatably connected to the first rotating member via a connecting unit, the second rotating member forming the transfer path and being rotatable about an axis in the main scanning direction, wherein the first and second rotating members vary a gap between the liquid ejection head and the surface of the first rotating member facing with the liquid ejection head by rotating in opposite directions and bending on the connecting unit.

According to the forth aspect of the present invention, the transfer path is formed by the first and second rotating members rotatably connected via a connecting unit. Therefore, it is possible to form a small recess on the transfer path by bending it on a part of the connecting unit. As a result, it is possible to increase or decrease a gap between the surface of the first rotating member facing the liquid ejection member and the liquid ejection member, that is, a medium gap by forming small recess on the transfer path the without moving the liquid ejection head. Thus, in case there is a problem that the rear end of the recording medium floats and thus contacts with the liquid election head or the recording medium is thick, it is possible to overcome the problem by enlarging the medium gap. Moreover, since the recess due to the bending of the transfer path is very small, the smooth transfer of the recording medium is not disturbed.

According to the fifth aspect of the present invention, the connecting unit is provided on a downstream side of a downstream side end of the liquid ejection head in a medium transfer direction.

According to the fifth aspect of the present invention, the connecting unit is provided on the downstream side of the downstream side end of the liquid ejection head in the transfer direction of the recording medium and does not face the liquid ejection head. As a result, even if a gap between the front end or the rear end and the liquid ejection head, that is, a medium gap is varied due to the recess of the transfer path based on the bending of the connecting unit during ejecting the liquid, recording quality does not become worse because the variation is uniformly continuous and very small in a region in which the recording head performs recording.

According to the sixth aspect of the present invention, the liquid ejection apparatus of the second aspect further includes a driving sending roller for transferring the medium to an upstream side of the platen unit, wherein a platen of a platen unit rotating with the first rotating member is provided on a position facing with the liquid ejection head, and a rotation axis of the first rotating member is provided on an upstream side of an axis of the driving sending roller.

According to the sixth aspect of the present invention, since the rotation axis of the first rotating member is provided on the upstream side of the axis of the driving sending roller, it is possible to make a rotation radius connecting the platen and the rotation axis of the first rotating member large. As a result, it is possible to make a difference in the angle of the recording medium around the platen smaller. Thus, it is possible to prevent a banding phenomenon because variation in the relation between a printing pitch and the sending amount becomes small.

Here, the banding phenomenon is that the spacing between printing lines becomes narrow or empty contrarily if printing by the print head and the nozzle for a line and paper sending are performed continuously during printing a line.

According to the seventh aspect of the present invention, the discharge roller includes a driving discharge roller and driven discharge roller, the driven discharge roller is provided on the discharge frame, the discharge frame and the driving discharge roller are provided on the second rotating member, and the driving and driven discharge rollers rotate in association with the rotation of the second rotating member by rotating the second rotating member without variation in relative position.

According to the seventh aspect of the present invention, when the second rotating member rotates into the second or B mode, the discharge frame rotates with the second rotating member and the medium pressing roller presses down the rear end of the recording medium. Moreover, since the driving discharge roller and the driven discharge roller rotate together by the rotation of the second rotating member, their relative positions is not varied. Thus, the recording medium can be discharged in same states in the first or A mode and the second or B mode.

According to the eighth aspect of the present invention, the liquid ejection apparatus according to the second aspect further includes a locking mechanism for fixing a position of the first rotating member in the first mode or mode A and the second mode or mode B, wherein the gap is either narrow one in the mode A or wide one in mode B, and the second rotating member is adapted to be rotated by operating a operation lever usually energized on the side of the second mode or mode B.

According to the eighth aspect of the present invention, since the recess of the transfer path is very small, it is possible to enlarge the gap between the surface of the first rotating member facing the recording head, that is, the medium gap without moving the liquid ejection head when the A mode is switched to the B mode. Thus, it is possible to switch the medium gap by switching the mode. In addition, after switching the first or A mode and the second or B mode, the switched mode is fixed immediately. Therefore, it is possible to perform switching and fixing the mode by one-touch. Moreover, since the position of the first rotating member is fixed directly, it is possible to stably maintain the gap between the surface of the first rotating member facing the liquid ejection head and the liquid ejection head.

According to the ninth aspect of the present invention, a liquid ejecting apparatus of the eighth aspect further includes a link lever moving in association with the rotation of the first rotating member via an engaging unit; and a lock lever pressed in a direction to the link lever by an all-time pressing means, wherein two stable positions, where rotation of the link lever is prohibited by the lock lever, are to be defined.

According to the ninth aspect of the present invention, it is possible to realize low cost and small space because the locking mechanism is formed with a small number of elements. Moreover, sometimes a moving distance of the platen is short and a user cannot recognize easily the moving when the first or A mode and the second or B mode are switched to each other. In this case, it is possible to acquire two stable positions by prohibiting the rotation of the link lever by the lock lever pressed toward the link lever. Thus, it is possible to make a good feeling of clicking and the user can operate easily.

According to the tenth aspect of the present invention, the link lever is formed in order for a distance between a rotating fulcrum and the engaging unit to be shorter than a distance between the rotating fulcrum and a contact point of the lock lever.

According to the tenth aspect of the present invention, since the distance between the rotating fulcrum and the engaging unit to be shorter than the distance between the rotating fulcrum and the contact point of the lock lever, it is possible to properly increase a lever ratio while maintaining the difference between the distances. Thus, it is possible to prohibit the first rotating member from rotating even if unexpected external force is applied to the first rotating member. Moreover, even if the user contacts the platen forming one body with the first rotating member, the first rotating member does not move easily.

According to the eleventh aspect of the present invention, a liquid ejecting apparatus according to the ninth aspect further includes a sensing device provided on a moving path of the engaging member accompanied by the rotation of the first rotating member, wherein the sensing device senses the link lever in any one of the first or second mode or mode A or B.

According to the eleventh aspect of the present invention, since the sensing device is provided on a moving path of the engaging member accompanied by the rotation of the first rotating member, it is possible to surely sense the rotating member via the link lever.

According to the twelve aspect of the present invention, a liquid ejection apparatus includes a liquid ejection head for ejecting liquid on a medium; a guiding member for regulating a distance between the medium and the liquid ejection head, the guiding member being formed to be elongated in a main scanning direction of the liquid ejection head and provided on a position facing with the liquid ejection head; a driving discharge roller for rotating in contact with and discharging the medium on which liquid ejection is performed, the driving discharge roller being provided on a driving discharge roller axis elongated in the main scanning direction of the liquid ejection head on a downstream side of the liquid ejection head; a driven discharge roller for rotating in contact with the driving discharge roller; a driven discharge roller supporting frame for supporting the driven discharge roller, the driven discharge roller supporting frame being formed to be elongated in the main scanning direction of the liquid ejection head; and a main frame for supporting a rotation axis of the driving discharge roller together with the guiding member and the driven discharge roller supporting frame, wherein the guiding member includes a first guiding member provided on an upstream side of the liquid ejection head in a medium transfer direction, and a second guiding member provided on a downstream side of the liquid ejection head in the medium transfer direction, the second guiding member being able to be connected to the first guiding member with a snap type connecting unit, the second guiding member and the driven discharge roller supporting frame are integrated to form a unit, and the unit is adapted to be installed on the main frame by connecting the second guiding member to the first guiding member supported by the main frame.

According to the twelve aspect of the present invention, the guiding member is supported by the driving discharge roller rotation axis, the driven discharge roller supporting frame, and the main frame. Moreover, the guiding member is formed by the first guiding member of the upstream side and the second guiding member of the downstream side. The second guiding member and the driven discharge roller supporting frame are integrated to form a unit. Therefore, it is possible to increase an assembling efficiency since the second guiding member and the driven discharge roller supporting frame can be installed on the main frame by installing the unit on the main frame after the unit is configured by forming one body with the second guiding member and the driven discharge roller supporting frame.

Moreover, since the first and second guiding members can be connected by a snap type connecting means, it is enough to connect the second guiding member to the first guiding member in a snap type during installing the unit on the main frame. Therefore, it is possible to install the unit on the main frame in a simple manner without using means such as a screw.

Furthermore, although the first guiding member is directly installed on the main frame, the second guiding member is installed to the main frame via the first guiding member. Therefore, even if temperature variation is generated in the second guiding member, large stress does not generate because the second guiding member is not directly bound to the main frame. Therefore, even if the guiding member is formed by the first guiding member and the second binding member separately, it is possible to lessen risk of stress deformation of the guiding member and maintain good printing quality by lessen or prohibit the variation in the gap between the recording medium and the liquid ejection head because the second guiding member is not directly bound to the main frame.

Similarly, the driven discharge roller supporting frame is also installed on the main frame via the first guiding member. In other words, the driven discharge roller supporting frame is not bound to the main frame. Therefore, it is possible to lessen or prohibit the deformation of the driven discharge roller supporting frame. Thus, since it is possible to maintain the position of the driven discharge roller constantly for a long time, it is possible to prevent printing quality from being worse (forming roller contact traces) due to the driven discharge roller's contacting strongly with the recording medium.

Moreover, in case the unit is removed from the fluid ejection apparatus, it is enough to decouple the first and second guiding members. Therefore, it is possible to improve maintenance and handling of the apparatus and to provide the recording medium in consideration of environmental merits by increasing recycling and/or reusing convenience.

According to the thirteenth aspect of the present invention, the second guiding member and the driven discharge roller support frame are engaged with each other by a snap type fitting means in order to form the unit.

According to the thirteenth aspect of the present invention, assembling efficiency is more improved since second guiding member and the driven discharge roller support frame are engaged with each other by the snap type fitting means in order to form the unit.

According to the fourteenth aspect of the present invention, the second guiding member includes a supporting unit for supporting the rotation axis of the driving discharge roller, and the rotation axis of the driving discharge roller is integrated with the unit to be a part of the unit.

According to the fourteenth aspect of the present invention, since the second guiding member includes the supporting unit for supporting the rotation axis of the driving discharge roller and the rotation axis of the driving discharge roller is integrated with the unit to be a part of the unit, it is possible to install the unit on the main frame after making the driven discharge roller rotation axis supported by the second rotating member and making one body with the driven discharge roller rotation axis. Thus, it is possible to increase working efficiency.

According to the fifteenth aspect of the present invention, the rotation axis of the driving discharge roller is formed to be supported by an axis receiving unit provided on the main frame via a bush member.

According to the fifteenth aspect of the present invention, the rotation axis of the driving discharge roller is supported to the main frame via the bush member. Therefore, it is possible to install easily the rotation axis of the driving discharge roller on the main frame by installing the bush member on the rotation axis of the driving discharge roller in advance.

According to the sixteenth aspect of the present invention, the first guiding member is adapted to swing around a swing axis provided on a upstream side of the connecting unit of the first and second guiding members, the second guiding member is adapted to swing around a swing axis provided on a downstream side of the connecting unit of the first and second guiding members, and a gap between the medium and the liquid ejection head is adjustable by swing operations of the first and second guiding members.

According to the sixteenth aspect of the present invention, since each of the first and second guiding members is adapted to swing, it is possible to adjust the gap between the recording medium and the recording head. Therefore, it is possible to adjust the gap without moving the liquid ejection head up and down and thus it is possible to make a gap adjusting mechanism with a simple configuration and low cost.

According to the seventeenth aspect of the present invention, the liquid ejection apparatus of the sixteenth aspect further includes a rotatable operation lever for performing the swing operation of the second guiding member, the operation lever being provided on a downstream side of the second guiding member, wherein the second guiding member includes a rotation end which is formed to be elongated in a direction toward the operation lever and to be able to deform elastically in a longitudinal direction of the second guiding member, the operation lever and the rotation end are adapted to operate in association with each other by engaging a protrusion formed on the rotation end to protrude in a longitudinal direction of the second guiding member with a hole formed on the operation lever, and an inclined surface for guiding the protrusion into the hole is formed on an upside of the hole.

According to the seventeenth aspect of the present invention, since the protrusion formed on the rotation end to protrude in a longitudinal direction of the second guiding member is engaged with the hole formed on the operation lever, the operation lever moves in association with the second guiding member. Moreover, since the inclined surface for guiding the protrusion into the hole is formed on an upside of the hole and the rotation end is adapted to deform elastically in the protruding direction of the protrusion (the longitudinal direction of the second guiding member), if the second guiding member is moved downward perpendicularly from the upside of the operation lever, the protrusion is guided to the hole by the inclined surface and they are engaged which is accompanied by the elastic deformation of the rotation end. Therefore, it is possible to simply engage the second guiding member and the operation lever by a simple operation of moving the second guiding member downward from the upside of the operation lever.

BRIEF DESCRIPTION OF THE DRAWINGS

The above and other objects, features and advantages of the present invention will become more apparent from the following description of the presently preferred exemplary embodiments of the invention taken in conjunction with the accompanying drawings, in which.

DETAILED DESCRIPTION OF THE INVENTION

Figure 1:
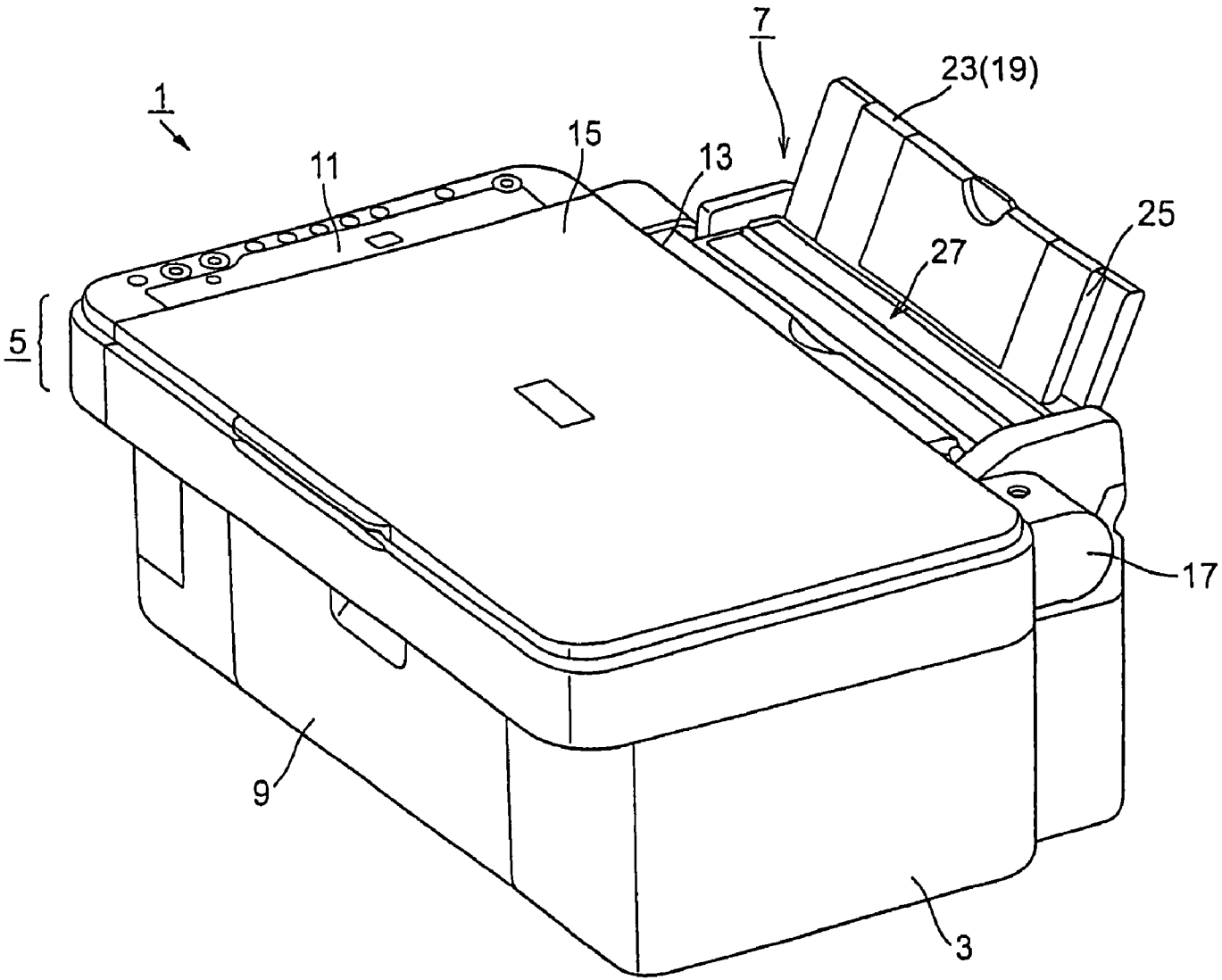
FIG. 1 is a perspective view of a fluid ejection apparatus according to the present invention.
Figure 2:
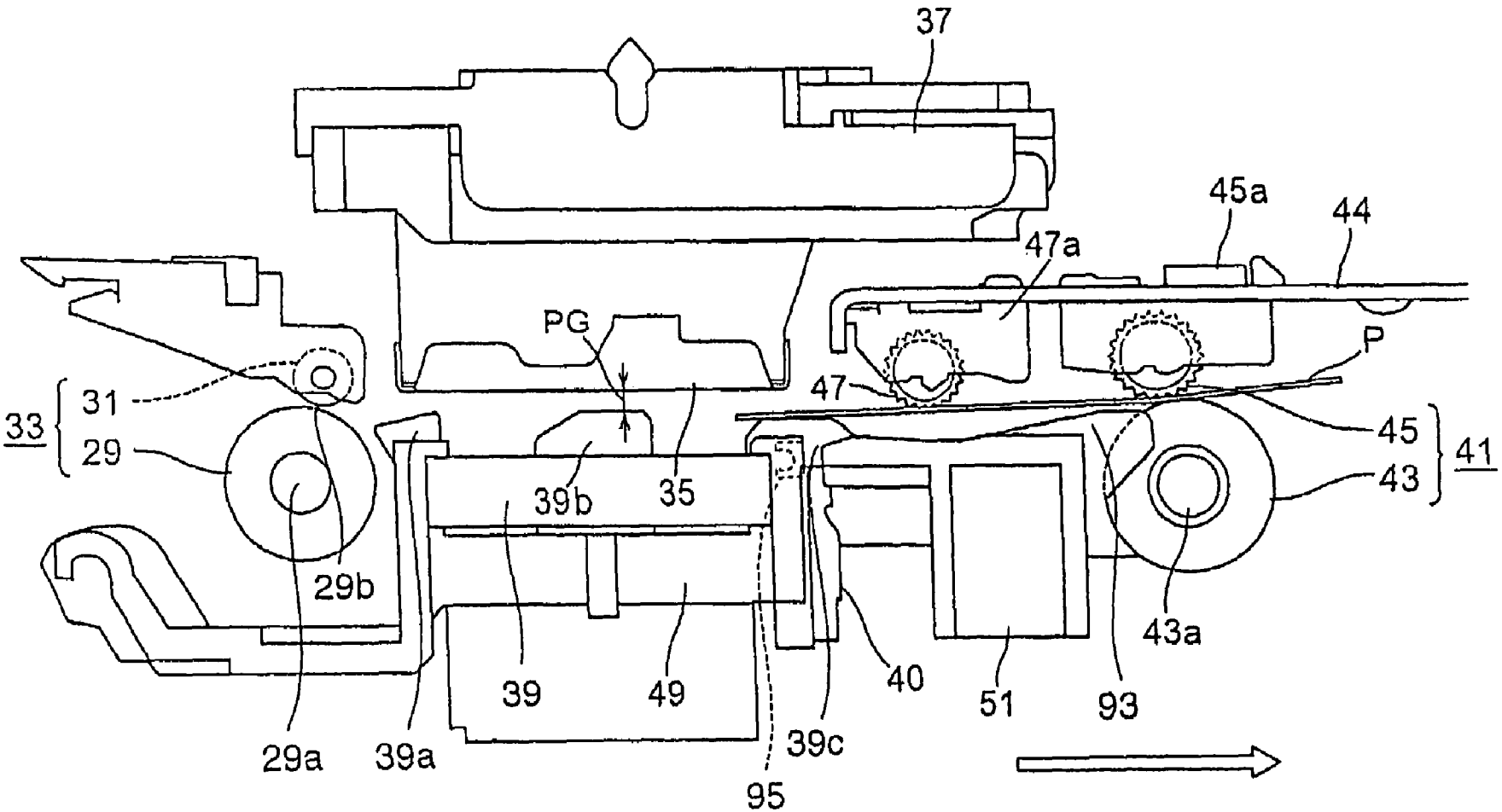
FIG. 2 is a side cross-section view showing a medium pressing roller before a discharge frame rotates.
Figure 3:
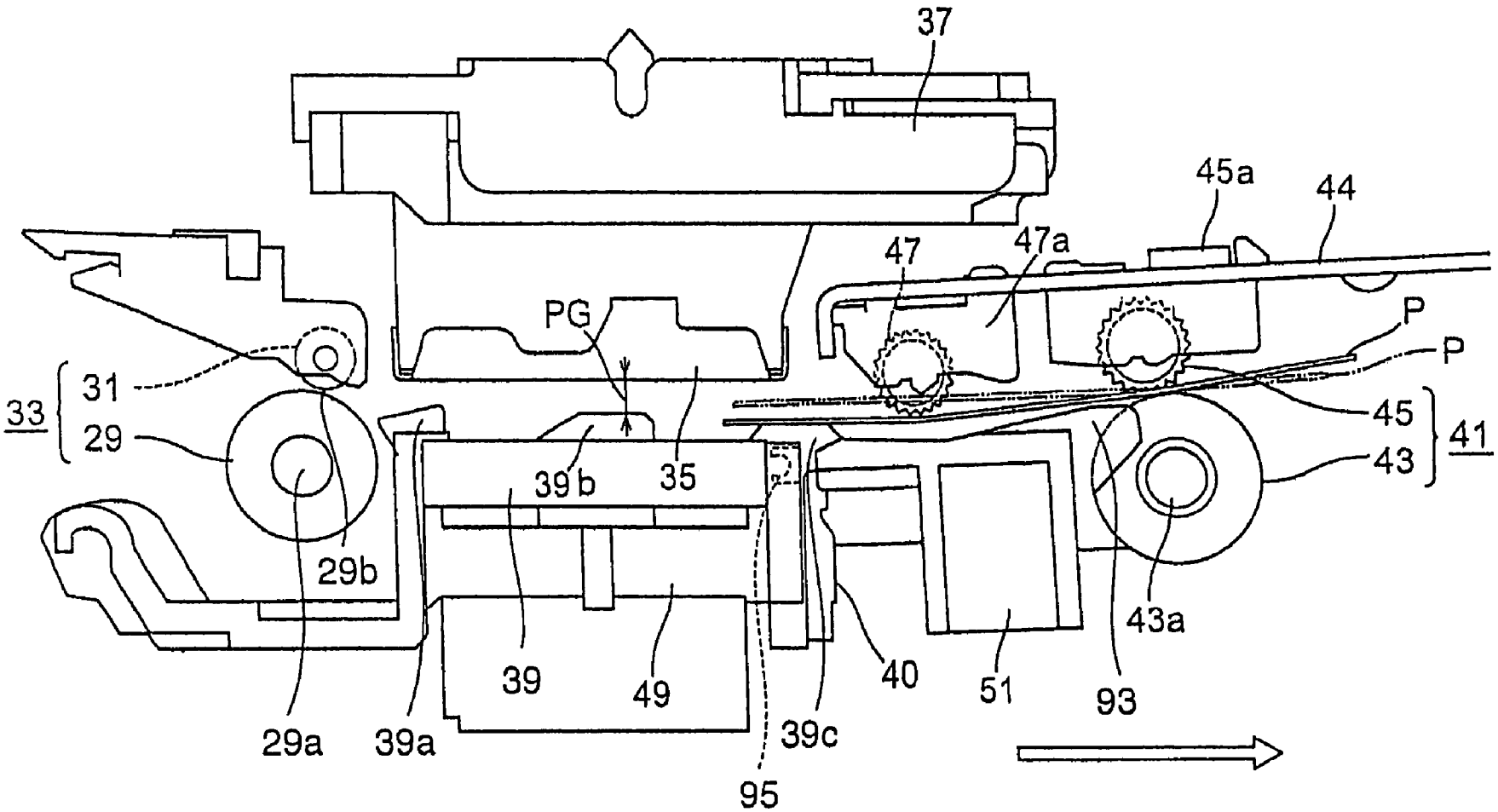
FIG. 3 is a side cross-section view showing that the medium pressing roller suppresses floating of the rear end of a recording medium downwardly by rotating the discharge frame.
Figure 4:
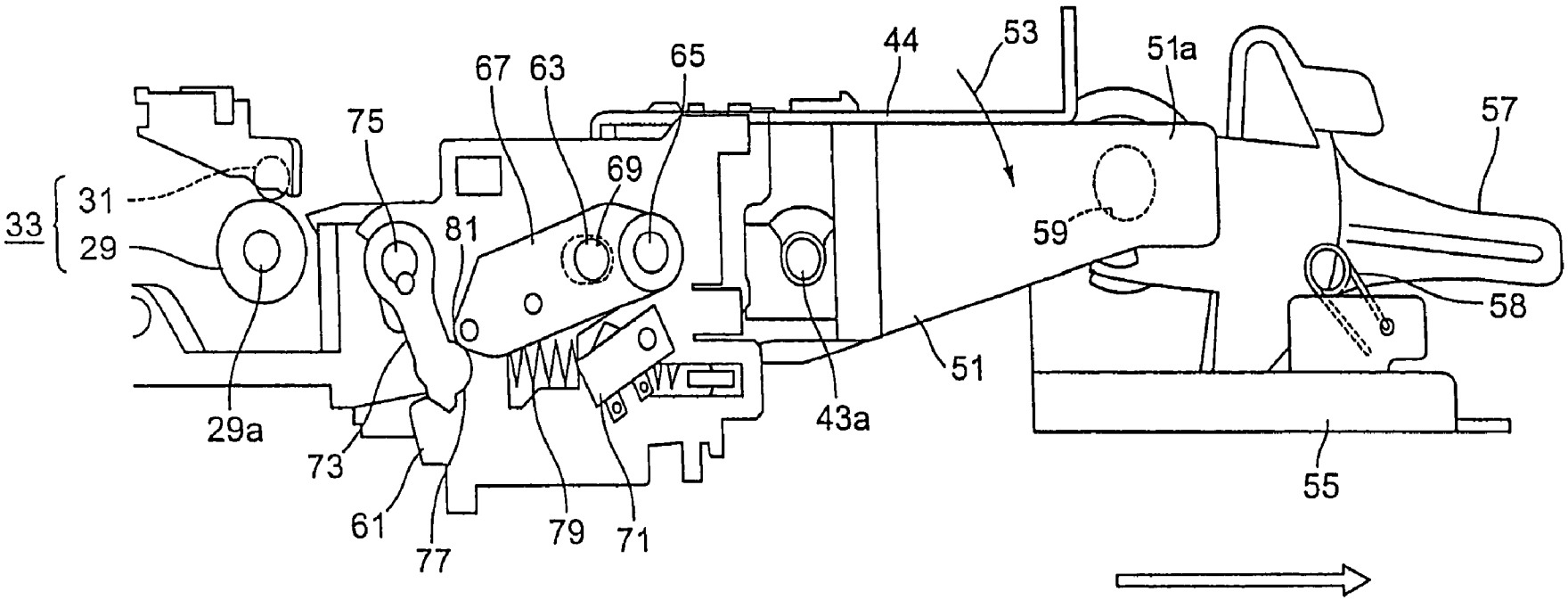
FIG. 4, which corresponds to FIG. 2, is a side cross-section view showing a rotation conveying mechanism before the discharge frame rotates.
Figure 5:
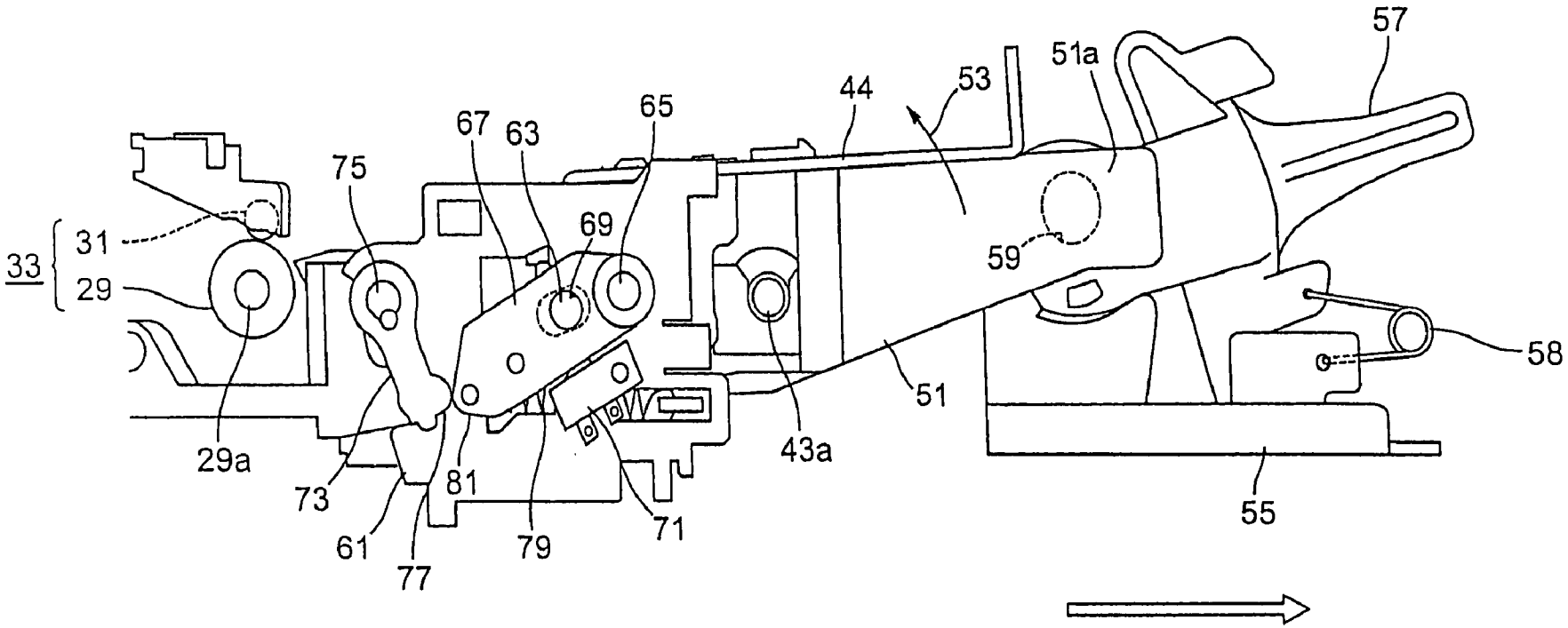
FIG. 5, which corresponds to FIG. 3, is a side cross-section view showing the rotation conveying mechanism after the discharge frame rotates.

Hereinafter, embodiments of the present invention will be described with reference to the drawings. FIG. 1 is a perspective view of a fluid ejection apparatus according to the present invention. FIG. 2 is a side cross-section view showing a medium pressing roller before rotation of a driven discharge roller supporting frame (herein after, referred to "discharge frame"). FIG. 3 is a side cross-section view showing that the medium pressing roller suppresses floating of the rear end of a recording medium downwardly by rotating the discharge frame. FIG. 4, which corresponds to FIG. 2, is a side cross-section view showing a state of a rotation conveying mechanism by operating an operation lever before the discharge frame rotates. FIG. 5, which corresponds to FIG. 3, is a side cross-section view showing the rotation conveying mechanism by operating the operation lever after the discharge frame rotates.

Figure 6:
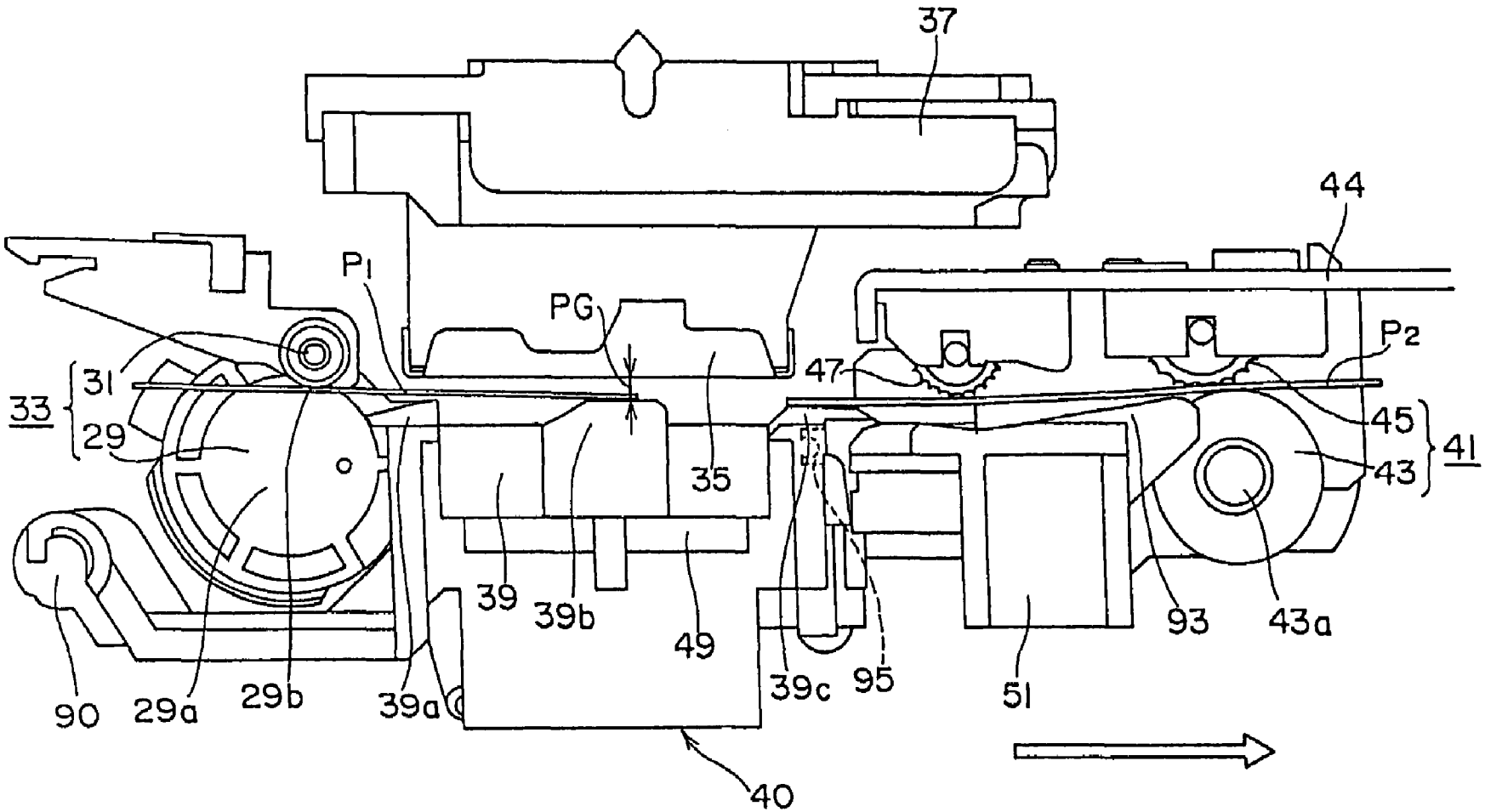
FIG. 6 is a side cross-section view showing a first mode or an A mode before a first rotating member and a second rotating member rotate.
Figure 7:
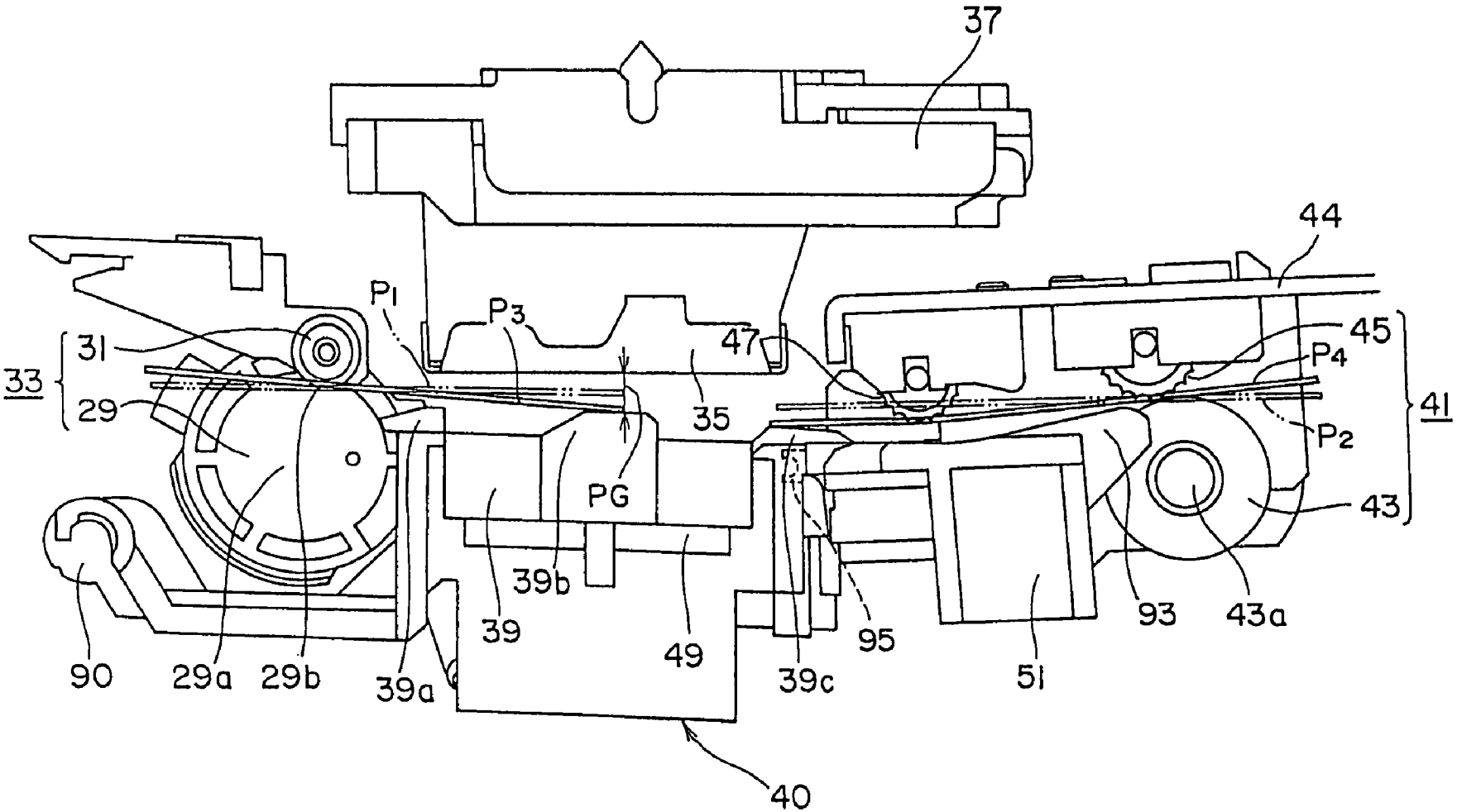
FIG. 7 is a side cross-section view showing a second mode or a B mode after the first rotating member and the second rotating member rotate.
Figure 8:
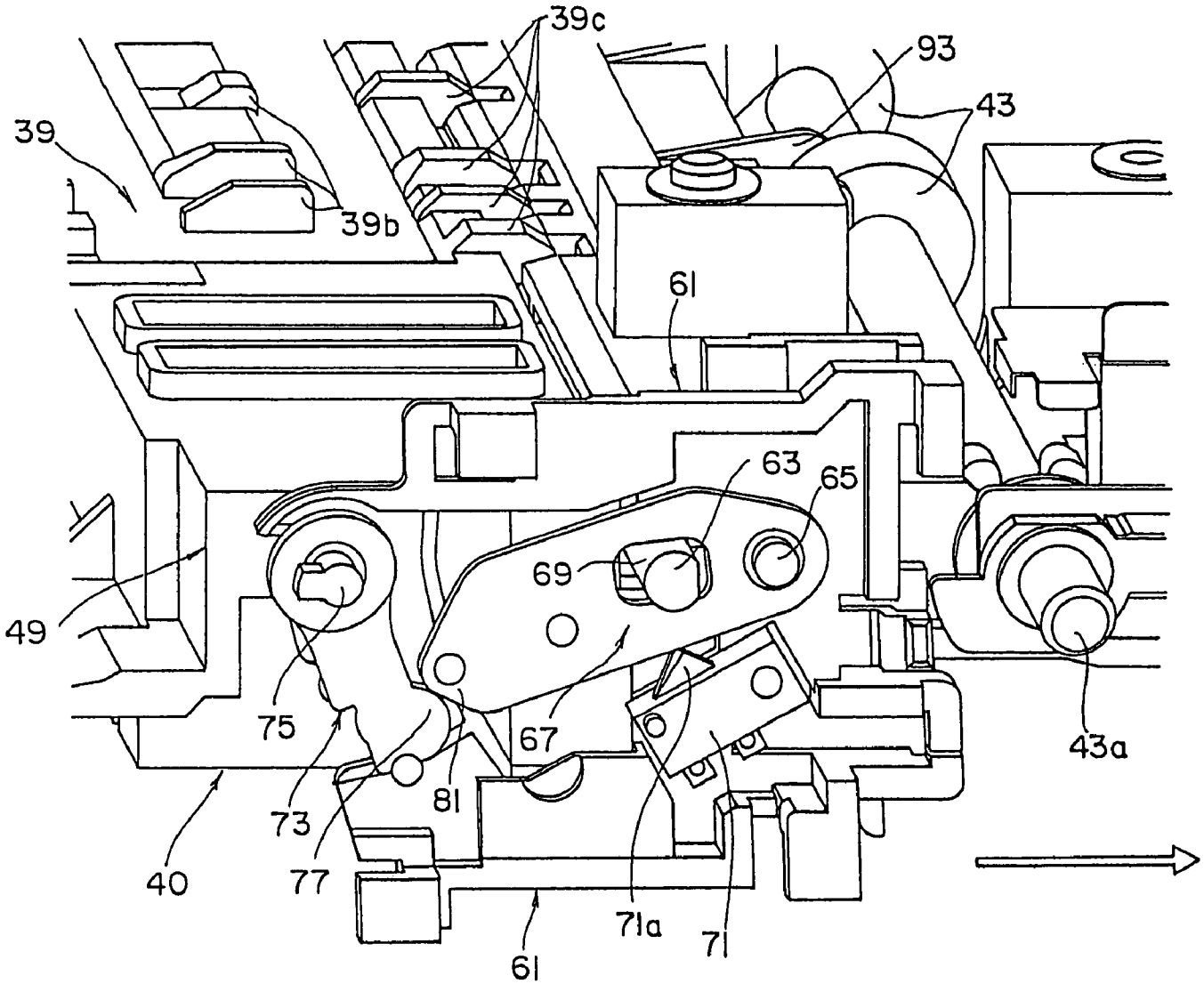
FIG. 8 is an enlarged perspective view of a locking mechanism unit according to the first mode or the A mode.
Figure 9:
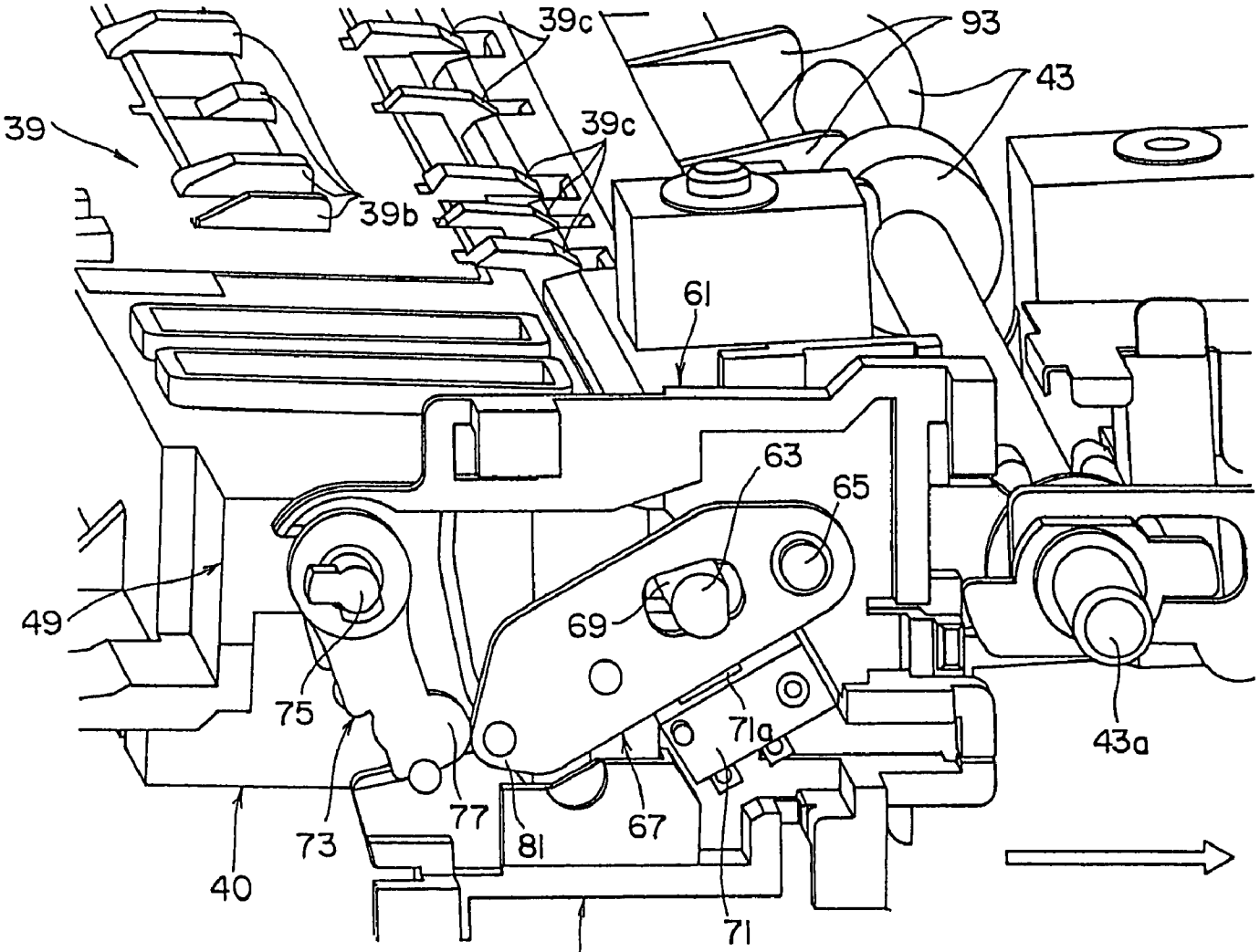
FIG. 9 is an enlarged perspective view of the locking mechanism unit according to the second mode or the B mode.
Figure 10:
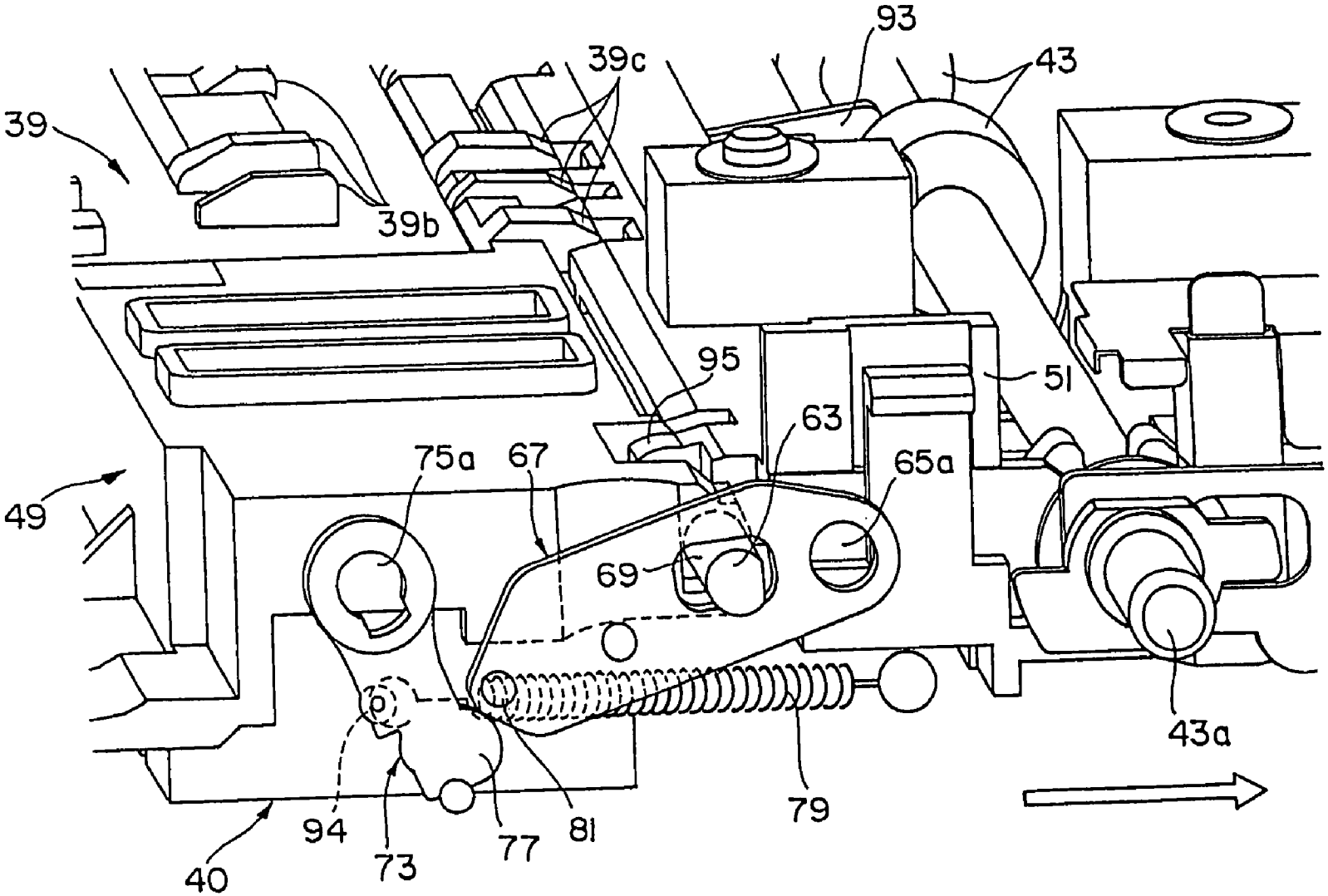
FIG. 10 is an enlarged perspective view excepting a link lever holder from FIG. 8.

FIG. 6 is a side cross-section view showing a first mode or an A mode before a first rotating member and a second rotating member rotate, wherein the first rotating member is provided upstream of a medium guiding member, that is, upstream of a driving send roller in FIG. 2. Similarly, FIG. 7 is a side cross-section view showing a second mode or a B mode after the first rotating member and the second rotating member rotate, wherein the rotation axis of the first rotating member is provided at the end of the medium guiding member on the upstream side, that is, upstream of the shaft of the driving send roller in FIG. 3. FIG. 8, which corresponds to FIG. 6, is an enlarged perspective view of a locking mechanism unit according to the first mode or the A mode before the first and second rotating members rotate. FIG. 9, which corresponds to FIG. 7, is an enlarged perspective view of the locking mechanism unit according to the second mode or the B mode after the first and second rotating members rotate. FIG. 10 is an enlarged perspective view excepting a link lever holder from FIG. 8. Although FIGS. 6 and 7 do not include the operation lever shown in FIGS. 4 and 5, let them have the operation lever.

A recording apparatus 1 shown in FIG. 1, which is an example of the fluid ejection apparatus, is a type of having a function of a scanner in addition to a function of a printer. The recording apparatus 1 includes an apparatus main body 3, a scanner unit 5 on the top surface of the apparatus main body 3, and a feeding unit 7 in the rear of the scanner unit 5.

As described with regard to FIG. 2 as follows, the apparatus main body performs mainly a function of ink-jet printer. In FIG. 1, the member indicated by the reference numeral 9 shows a discharge receiving unit. The discharge receiving unit 9 is used in a state of rotating substantially 90° to receive a recording medium which is recorded when the apparatus 1 is used as a printer. An operation lever 11 is on the left side of the top surface and switches a scanning function using the scanner unit 5, a recording function of the apparatus main body 3 and a function of recording a scanned image.

The scanner unit 5 includes a cover 15 capable of opening and closing by rotating upward about a rotation axis 13. Under the cover 15A, a glass mounting surface (not shown) for mounting a printed matter which is an object to be scanned is provided. Moreover, a scanning apparatus (not shown) is provided below the glass mounting surface. The scanner unit 5 rotates upward about the rotation axis 17 as one body and thus the top of the apparatus main body is open. Thus, it is possible to perform maintenance of members such as a carriage in a recording unit.

As shown in FIG. 1, the feeding unit 7 is closed by the cover 19 during non-use. By rotating the cover 19 rearward of FIG. 1, the feeding unit 7 is open. Moreover, by fixing the cover 19 at a predetermined angle, the cover 19 functions as a medium support 23. The medium support 23 is provided with an edge guide 25 movable to measure the width of a recording medium P. When the cover 19 is open, a feeding aperture 27 is formed in the feeding unit 7. The recording media P with which the medium support 23 is stocked are sent sequentially from the feeding aperture 27 to the recording unit by a sending mechanism not shown.

In FIG. 2, members around the path of the recording medium P being sent from the left side (upstream side) to the right side (downstream side) are shown. The recording medium P sent from the feeding unit 7 comes to a transfer roller 33 (herein after, referred to "sending roller") including a lower driving discharge roller 29 driven to rotate (herein after, referred to "driving sending roller") and an upper and rotatable driven discharge roller 31 ("referred to "driven sending roller"). Then, the recording medium P is fed into a recording head 35 which is on the upstream of the direction in which the recording medium P is transferred. At this time, the sending of the recording medium P is controlled by a driving system precisely during recording. A carriage 37 holds the recording head 35 and can make a round-trip in the main scanning direction (direction of the back surface of FIG. 2) perpendicular to the direction of feeding (transferring) the recording medium P. A platen unit 40 corresponding to the "guiding member" is opposed to the recording head 35. On a side of the platen unit 40 facing the recording head, a platen 39 is provided. The platen 39 supports the recording medium P from the underside while recording on the recording medium P is performed by the head 35.

In addition, in order to guide the recording medium P smoothly, a first rib 39*a*, a second rib 39*b*, and a third rib 39*c* are provided on the upstream side of the transferring direction of the platen 39, on a surface of the platen 39 opposed to the recording head, and on the downstream side of the platen 39, respectively. Moreover, a position indicated by the reference numeral 29*b* is a nip point of the sending roller 33.

The first, second, and third ribs 39*a*, 39*b*, and 39*c* define a gap between the recording medium P and the recording head 35 (herein after, referred to "medium gap PG") by supporting the recording medium P from the underside while recording on the recording medium P is performed by the head 35.

The distance between the recording head 35 and the top surface of the platen 39, that is, the medium gap PG, may be properly adjusted according to the thickness of the recording medium P. When the medium gap PG is properly adjusted, the recording medium P passes through the first, second and third ribs 39*a*, 39*b* and 39*c* smoothly, and thus high quality recording is performed. The recording media P on which the recording head 35 records are discharged sequentially by a discharge roller 41. The discharge roller 35 includes a lower driving discharge roller 43 driven to rotate and an upper driven discharge roller 45 (herein after, referred to "notched discharge roller") which is supported to freely rotate via a holder 45 of a discharge frame 44. The recording medium P is drawn out to be discharged by rotation of the rollers 35. Moreover, on a side of the proximal end of the discharge frame 44 (upstream side of the transferring direction), a medium pressing roller 47, which suppresses floating of the recording medium P, is provided via a holder 47*a* between the recording head 35 and the discharge roller 41. According to the present embodiment, the discharge frame 44 is made of metal.

Moreover, a guide 93 for guiding the recording medium to the discharge roller 41 is provided on the upstream side of the transferring direction of the driving discharge roller 43.

In FIGS. 2 and 3, a member indicated by a reference numeral 49 is a medium guiding front member corresponding to the first rotating member or the first guiding member. The medium guiding front member 49 is provided with the platen unit 40 forming one body. The platen unit 40 rotates which is accompanied by the rotation of the medium guiding front member 49. A member indicated by a reference numeral 51 is a member guide front assistant member corresponding to the second rotating member or the second guiding member. These members will be described in the following.

The medium guide front member 49 connects with a connecting unit 95 provided in the medium guide front assistant member 51 and is rotatable about the main scanning direction.

Then, the characteristic configuration of the present invention is described with reference to FIGS. 4 and 5. As shown in FIG. 4, the medium guide front assistant member 51 is provided under the discharge frame 44 forming one body. The medium guide front assistant member 51 shown in FIG. 5 rotates about a rotation axis of the driving discharge roller formed by a metal shaft (herein after, referred to "axis") which is a rotation axis of the discharge roller 43 in the direction of an arrow 53 shown in FIG. 4 to be in a state shown in FIG. 4. A rotation end 51*a* of the medium guide front assistant member 51, that is, an end of the rotation end 51*a* forming a shape extending toward the operation lever 57 is provided with a protrusion 51*h* shown in FIG. 18. In the mean time, a lever installing plate 55 for performing a shaking operation of the medium guide front assistant member 51 is provided adjacent to the medium guide front assistant member 51 (on the downstream side of the medium guide front assistant member 51. The operation lever 57 is installed to be rotatable vertically on the lever installing plate 55. A spring member 58 is installed on the operation lever 57 and enforces the operation lever 57 to turn upwards as shown in FIG. 5 all the time.

A hole 59 is formed in one end of the operation lever 57. By the protrusion 51*h* (FIG. 18) being caught in (inserted in) the hole 59, the medium guide front assistant member 51 rotates with the discharge frame 44 in the clockwise direction of FIG. 4 about an axis 43*a* of the discharge roller 43 when the operation lever 57 is moved downward as shown in FIG. 4. Moreover, as shown in FIG. 5, the medium guide front assistant member 51 rotates with the discharge frame 44 in the clockwise direction of FIG. 4 about the axis 43*a* of the discharge roller 43 when the operation lever 57 moves up.

Thus, the medium pressing roller 47 provided on the upstream side of the axis 43*a* of the discharge roller 43 moves to an upper position as shown in FIG. 2 when the operation lever 57 is moved down. The medium pressing roller 47 moves downward to press the rear end of the recording medium P downwardly as shown in FIG. 3 when the operation lever 57 is moved up.

On the other hand, the medium guide front assistant member 51 is rotatably connected to the medium guide front member 49 via the connecting unit 95. An axis 29*a* of the driving sending roller 29 is rotatably connected to the end of the upstream side of the feeding direction of the medium guide front member 49. Thus, when the medium guide front assistant member 51 rotates in the counterclockwise direction from a position shown in FIG. 4, the medium guide front member 49 rotates in the clockwise direction of FIG. 4 around the axis 29*a* of the driving sending roller 29.

At this time, as shown in FIG. 2, the sending roller 33, the first rib 39*a*, the second rib 39*b*, the third roller 39*c*, the platen 39, and the platen unit 40 form one body with the medium guide front member 49. Therefore, when the medium guide front assistant member 51 rotates in the clockwise direction about the axis 43*a* of the paper discharge roller from a position shown in FIG. 2, the medium guide front member 49 rotates with the members forming one body in the clockwise direction about the axis 29*a* of the driving sending roller 29. FIG. 3 shows a state after the rotation.

A perforating aperture unit 65*a* is formed in the link lever 67. A rotation fulcrum 65 passes through the perforating aperture unit 65*a* so that the link lever 67 rotates about the rotation fulcrum 65 (see FIG. 10). A protrusion 63 is formed on a side of the medium guide front member 49. A hole 69 receiving the protrusion 63 is formed in the link lever 67.

A lever holder 61 is provided to be adjacent to the medium guide front member 49. The protrusion 63 is formed on the medium guide front member 49 and protrudes from a long hole (not shown) formed in the link lever holder 61. The link lever holder 61 is provided with the link lever 67 having the rotation fulcrum 65 on the downstream side of the protrusion 63 in the feeding direction. The link lever 67 is provided with the hole 69 which the protrusion 63 passes through. Due to the above configuration, the protrusion 63 moves upward and downward which is accompanied by the rotation of the medium guide front member 49 and thus the link lever 67 can rotates in the clockwise or counterclockwise direction about the rotation fulcrum 65.

A sensing device 71 is provided below the link lever 67. The sensing unit 71 senses the distance from the bottom side of the link lever 67 and determines whether the medium pressing roller is in a state of FIG. 2 or FIG. 3.

A perforating aperture unit 75*a* is formed in a lock lever 73 and a rotation fulcrum 75 passes through the perforating aperture unit 75*a* so that the lock lever 73 rotates about the rotation fulcrum 75. A protrusion 94 is formed on the lock lever 73 and connected to an end of a tensile coil spring 79 which is a spring pressing the lock lever 73 toward the link lever 67 (see FIG. 10).

The lock lever 73, which is rotatable around the rotation fulcrum 75, is provided on the upstream side of the link lever 67 in the feeding direction. A stopping protrusion 77 is formed on the free end of the lock lever 73. Moreover, the tensile coil spring 79 is connected to the free end of the lock lever 73. Thus, the free end of the lock lever 73 is always pressed rotatably in the counterclockwise of FIG. 4. The protrusion 63, the link lever 67, the lock lever 73, and the tensile coil spring 79 constitute a locking mechanism.

A cam 81 is formed on the free end of the link lever 67. The cam 81 is stopped by the upper side of the stopping protrusion 77 when the link lever 67 rotates upward and this state is maintained (see FIG. 4). The cam 81 is stopped by the lower side of the stopping protrusion 77 when the link lever 67 rotates downward and this state is maintained (see FIG. 5).

As described above, the lock lever 73 is pressed toward the link lever 67 by the tensile coil spring which is an all-time pressing means. Thus, it is possible to obtain two stable positions in which rotation of the link lever 67 is prohibited. Moreover, as the protrusion 63 is formed on the medium guide front member 49, it is possible to directly fix the position of the medium guide front member 49. At this time, as the medium guide front member 49 forms one body with the platen 39, the gap between the platen 39 and the recording head 35, that is, the medium gap PG is maintained stably for the first or A mode and the second or B mode.

When the first or A mode is switched to the second or B mode, it is difficult for a user to recognize the mode switch because the distance variation of the medium gap PG is set to substantially 0.9 mm for the present embodiment. In addition, as described above, the stopping protrusion 77 is formed on the lock lever 73 and the lock lever 73 is pressed toward the link lever 67. By this, the rotation of the link lever 67 is prohibited and two stable positions of the link lever 67 (see FIGS. 4 and 5 and FIGS. 8 and 9) are obtained. Therefore, it is possible to make a good feeling of clicking and the user can operate easily.

Moreover, it is possible to form the locking mechanism with a small number of elements, realize low cost and small space.

Furthermore, the distance between the rotation fulcrum 65 of the link lever 67 and a point at which the protrusion 63 is engaged to the hole 69 (let the point be the center of the protrusion 63) is shorter than the distance between the rotation fulcrum 65 and the cam 81 which is a contact point of the link lever 67 and the lock lever 73 (see FIGS. 4, 5, 8, 9, and 10). By maintaining the difference between the distances and properly increasing a lever ratio, it is possible to prohibit the platen unit 40 from rotating even if unexpected external force is applied to the platen unit 40. In other words, even if unexpected external force is applied to the platen unit 40, there is not a problem that the mode is changed. Thus, there is not a problem that the platen easily moves even if the user contacts the platen 39.

The sensing device is fixed on the link lever holder 61 so that a protruding piece 71*a* is opposed to the link lever 67 below the link lever 67. At this time, for the first or A mode, the link lever is not sensed by the sensing device 71. When the mode is changed to the second or B mode, the link lever 67 presses the protruding piece 71*a* by rotating in the counterclockwise and thus is sensed by the sensing device 71 (see FIG. 9).

Moreover, as shown in FIGS. 8 and 9, by placing the sensing device 71 on a moving path of the protrusion 63 which is accompanied by the rotation of the platen unit 40, it is possible to sense certainly an object to be sensed. In addition, as a radius of rotation of the link lever 67 with respect to the hole 69 is short, it is difficult for tolerance of axial run-out of the link lever 67, etc., to arise and there is not a problem of such a miss in sensing as the link lever 67 cannot touch the protruding piece 71*a*.

According to the present embodiment, the sensing device 71 is provided on the lower side of the link lever 67 and senses the link lever in the second or B mode. However, the sensing device 71 may be provided on the upper side of the link lever 67 and sense the link lever in the first or A mode.

Moreover, according to the present embodiment, the protrusion 63 is formed on the first rotating member 49 and the hole 69 is formed in the link lever 67 so as to engage with the protrusion 63. However, a protrusion and a recess may be formed on the first rotating member and the link lever, respectively and engage with each other.

In the following, the operation of the recording apparatus according to the present invention will be described. After recording on the recording medium P by using the recording apparatus 1, the rear end of the recording medium P does not bend as shown in FIG. 2 during discharging the recording medium P. In case the recording medium P does not contact with the recording head 35, the operation lever 57 moves downward as shown in FIG. 4. At this time, the distance between the recording head 35 and the platen 39, that is, the medium gap PG is relatively short and the recording apparatus 1 is in the first or A mode where the medium pressing roller 47 moves to an upper position.

In the first or A mode, the operation lever 57 moves downward in opposition to the spring force of the spring member 58 as shown in FIG. 4. As the protrusion 63 of the medium guide front member 49 moves to an upper position, the cam 81 of the link lever 67 is stopped by the upper side of the stopping protrusion 77. At this state, since the free end of the lock lever 73 is drawn by the tensile coil spring 79, engagement of the cam 81 and the stopping protrusion 77 is locked and the state where the operation lever 57 moves downward is maintained.

In the following, there will be description on the switching operation from the first or A mode to the second or B mode where the medium gap PG is large and the rear end of the recording medium P does not contact with the recording head 35 by moving the pressing roller downward as shown in FIG. 3.

By moving the operation lever 57 shown in FIG. 5 upward, the medium guide front assistant member 51 rotates about the axis 43*a* of the discharge roller in the counterclockwise direction of FIG. 5. Thus, the discharge frame 44, which is formed as one body with the medium guide front assistant member 51, rotates in the counterclockwise direction and the medium pressing roller 47 moves downward to press down the rear end of the recording medium P (see FIG. 3).

Moreover, the medium guide front member 49 rotates about the axis 29*a* of the driving sending roller in the clockwise direction of FIG. 5 which is accompanied by the rotation of the medium guide front assistant member 51 in the counterclockwise direction. As a result, the platen 39 which is formed as one body with the medium guide front member 49 moves downward as shown in FIG. 3 and the medium gap PG becomes larger.

Since a transfer path consists of the medium guide front member 49 and the medium guide front assistant member 51 which are connected so as to be rotatable with respect to each other as described above, it is possible to bend the transfer path. As a result, it is possible to enlarge the gap between the platen 39 and the recording head 35 by bending the transfer path even if the recording head 35 does not move. Therefore, it is possible to adjust the medium gap PG by the mode switch. Thus, it is possible to prevent the rear end of the recording medium for contacting with the recording head. Moreover, since the bending of the transfer path is small, the smooth transfer of the recording medium is not disturbed.

Moreover, according to the description with regard to FIGS. 2 to 5, the rotation fulcrum of the medium guide front member 49 is regarded as the axis 29*a* of the driving sending roller. In the meantime, FIGS. 6 and 7 shows another embodiment where the axis 29*a* of the driving sending roller is changed to a medium guide front member rotation axis 90 of the upstream end of the rotation fulcrum of the medium guide front member 49.

In FIG. 6, a member indicated by a reference numeral 90 is a medium guide front member rotation axis which is a rotation axis of the medium guide front member 49. The elements except the medium guide front member rotation axis 90 are indicated by the same reference numerals as those of FIG. 2 and explanation on the elements is emitted.

Since the rotation fulcrum is moved to the upper stream side, it is possible to make a rotation radius connecting the platen 39 and the medium guide front member rotation axis 90 larger. FIG. 6 shows the first or A mode. FIG. 7 shows the second or B mode where the medium guide front assistant member 51 and the medium guide front member 49 rotate from the state of FIG. 6 and the medium gap PG becomes larger. A recording medium P3 of FIG. 7 shows a state in the second or B mode to which a recording medium P1 of FIG. 6 in the first or A mode is changed. Similarly, a recording medium P4 shows a state of a recording medium P2 in the second or B mode. Since the rotation radius becomes larger by moving the rotation fulcrum to the upper side, it is possible to make a difference between the angles of the recording medium P1 and the recording medium P3 around the platen smaller when the first or A mode is changed to the second or B mode.

If the difference between the angles of the recording medium P1 and the recording medium P3 is large in the second or B mode where the medium gap PG is enlarged, a gap between ink drops ejected from each nozzle of the recording head 35 in a width scanning direction (the transfer direction) is constant but the paper transfer amount is varied (decreases) in a direction parallel to a nozzle forming surface by the difference in angle. In other words, since the ink is ejected with an inclination by the difference in angle with respect to a constant amount of the paper transfer, the gap in the width scanning direction is larger (variation in the print pitch). Thus, there is a problem of a banding phenomenon that causes color blur and a white line (part on which printing is not performed).

According to the present embodiment, it is possible to prevent the banding phenomenon by decreasing the difference of the angles of the recording medium P1 and the recording medium P3.

Moreover, according to present embodiment, the connecting unit 95 is provided on the downstream side of an end of the downstream side of the recording head 35 in the transfer direction of the recording medium and is not opposed to the recording head 35. As a result, even if the gap between the front end or the rear end of the recording medium and the recording head 35 during the recording, that is, the medium gap is varied due to a very small recess based on bending of the connecting unit 95, the variation is uniformly continuous and very small in a region in which the recording head 35 performs recording. Thus, there is not a problem of recording quality's becoming worse.

Moreover, the medium guide front member 49 rotates in the clockwise direction of FIG. 5 and thus the protrusion 63 makes the link lever 67 rotate about the rotation fulcrum in the counterclockwise direction of FIG. 5. At this time, the cam 81 of the link lever 67 acts on the stopping protrusion 77 so as to make the lock lever 73 rotate in the clockwise direction in opposition to the spring force of the tensile coil spring 79. Thus, the cam 81 goes over the stopping protrusion 77 and is stopped by the lower side of the stopping protrusion 77 shown in FIG. 5. Then, the free end side of the lock lever 73 is drawn by the tensile coil spring 79 and thus the state in which the cam 81 is stopped. The sensing device 71 senses whether or not the link lever 67 is adjacent to the sensing device 71 and generates a signal indicating the first or A mode or the second mode or B mode. According to the signal, a display unit on an operation panel 11 displays one of the modes.

According to the present embodiment, generally, the user conducts printing in the first or A mode. Then, when the user finds out a stain due to contact of the recording medium and the recording head, the user switches the mode to the second or B mode and thus it is possible to prevent the contact of the recording medium and the recording head. Moreover, if the mode is set to the second or B mode, the operation panel 11 displays the second or B mode. By this, the user can distinguish the first or A mode and the second or B mode as occasion demands and return to the first or A mode generally.

By this, according to the present invention, it is possible to easily increase or decrease the medium gap PG only by operating the operation lever 57 without moving a carriage 4 upward and down.

According to the present invention described above, it is possible to move the medium pressing roller downward according to the kind of the recording medium and prevent the rear end of the recording medium from contacting with the recording head by using a relatively simple constitution.

In the following, other features of the present invention will be explained referring to FIGS. 11 to 19 and other pertinent figures. The "medium guide front member 49" is changed to a "first guiding member 49" and the "medium guide front assistant member 51" is changed to a "second guiding member 51."

Figure 11:
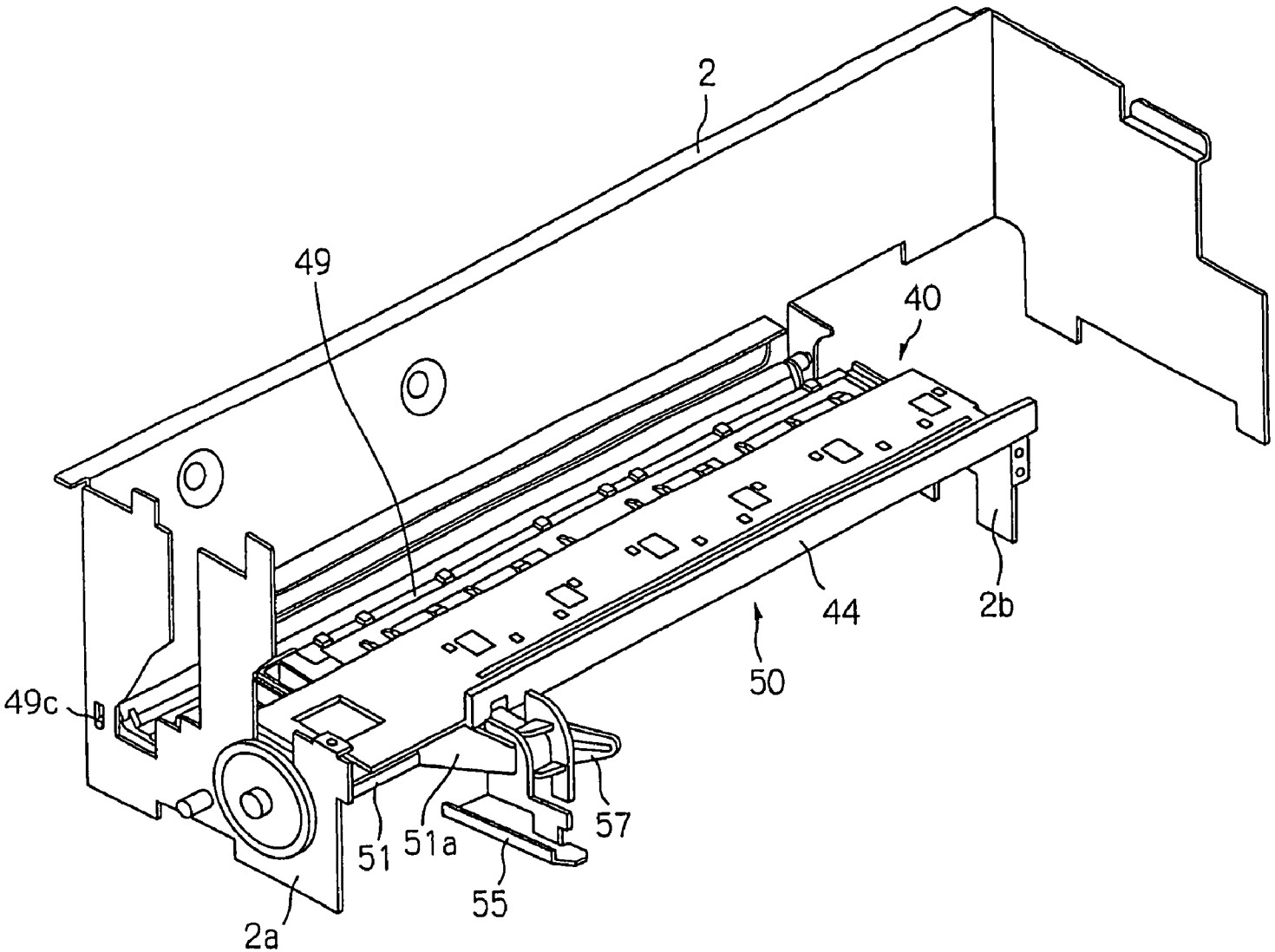
FIG. 11 is a perspective view of a main frame.
Figure 12:
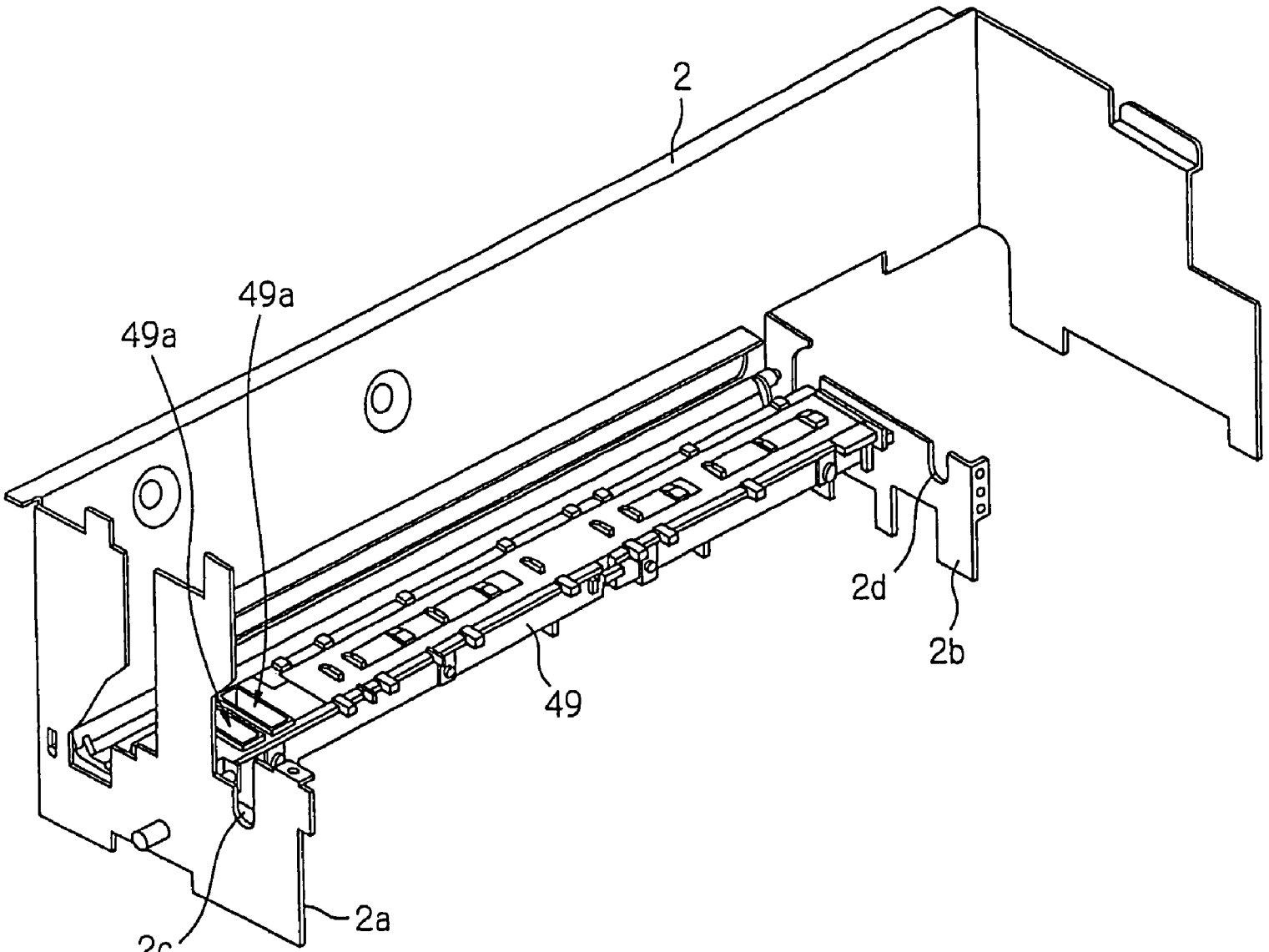
FIG. 12 is a perspective view of the main frame.
Figure 13:
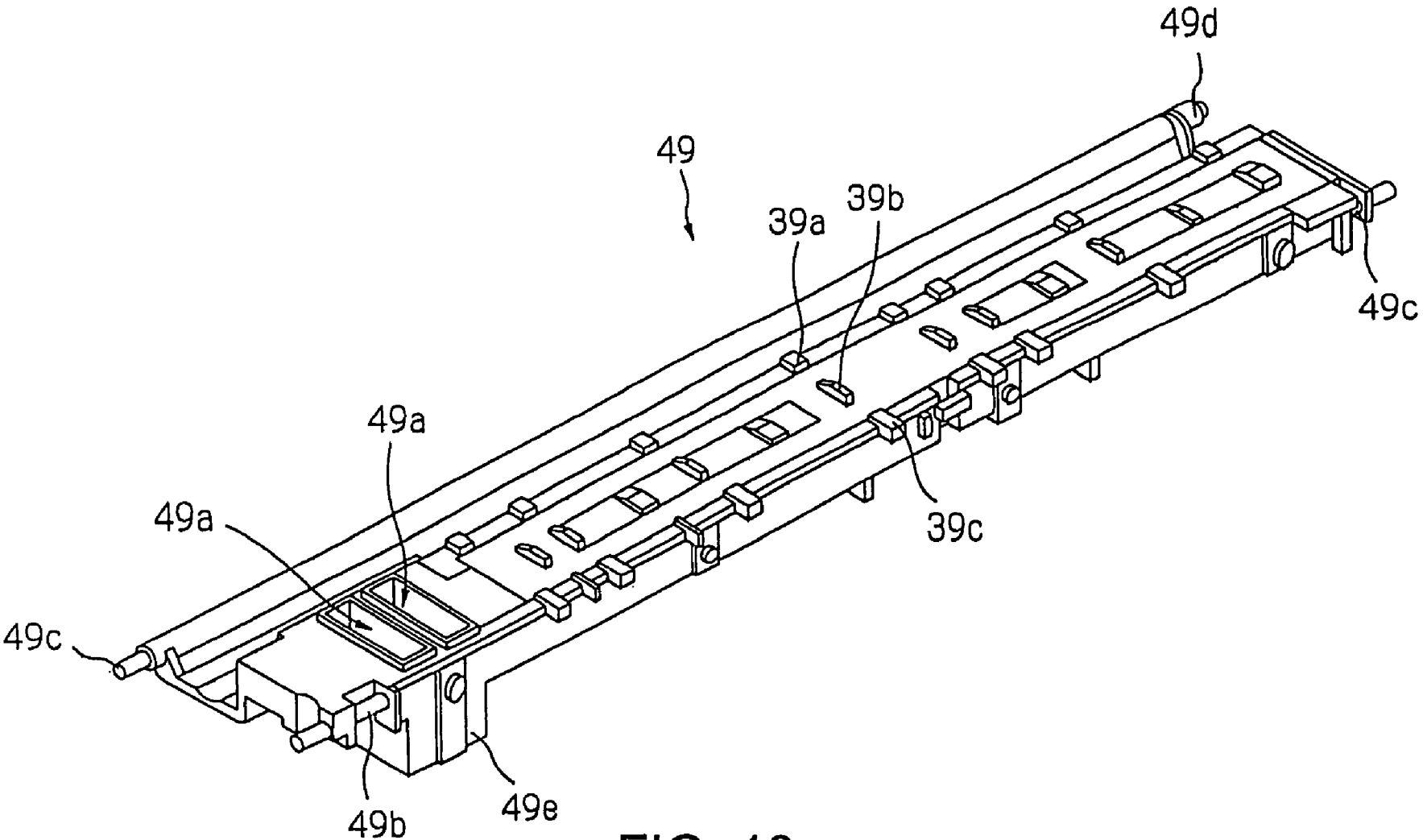
FIG. 13 is a perspective view of a first guiding member.
Figure 14:
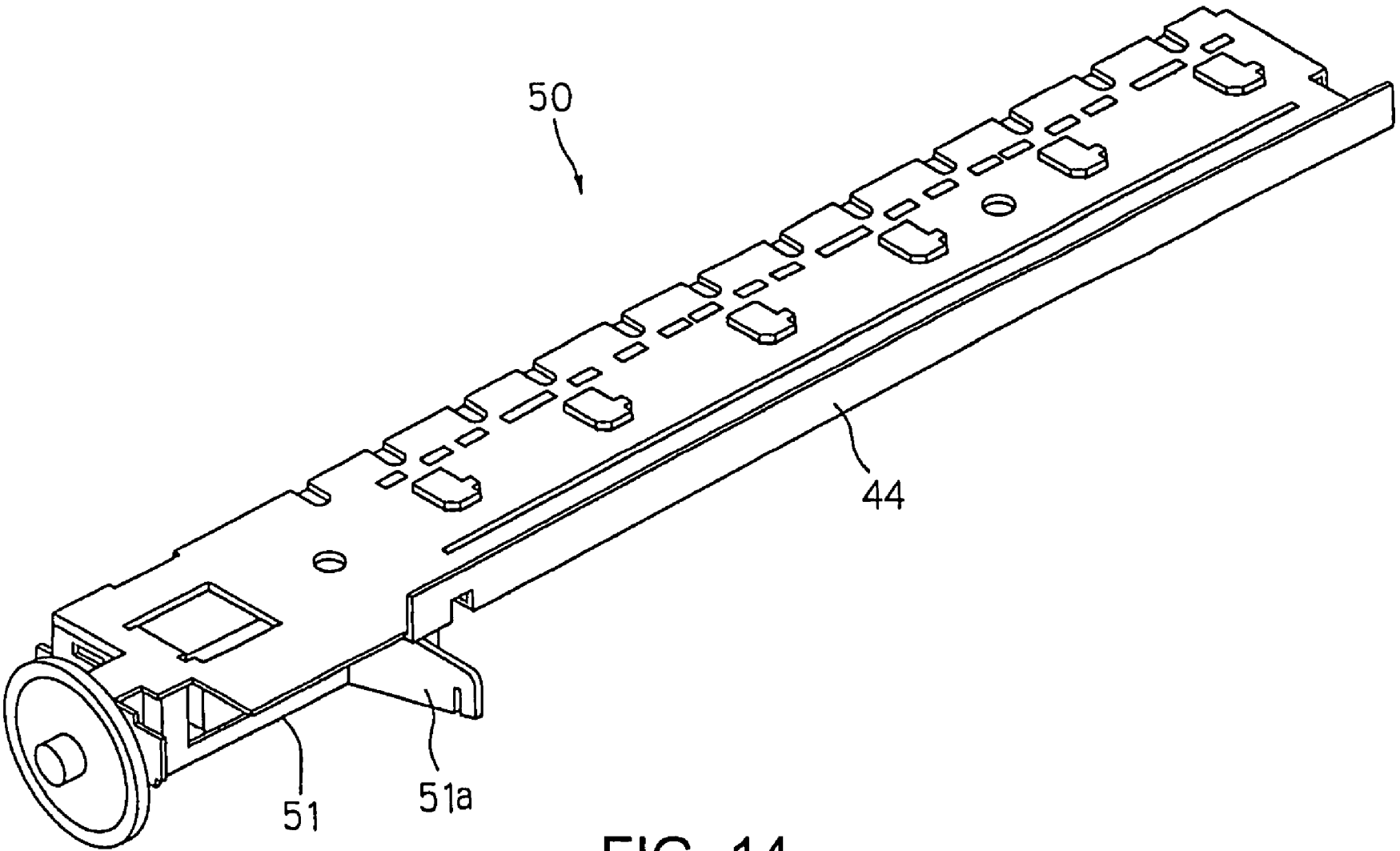
FIG. 14 is a perspective view of a unit including a second guiding member and the discharge frame.
Figure 15:
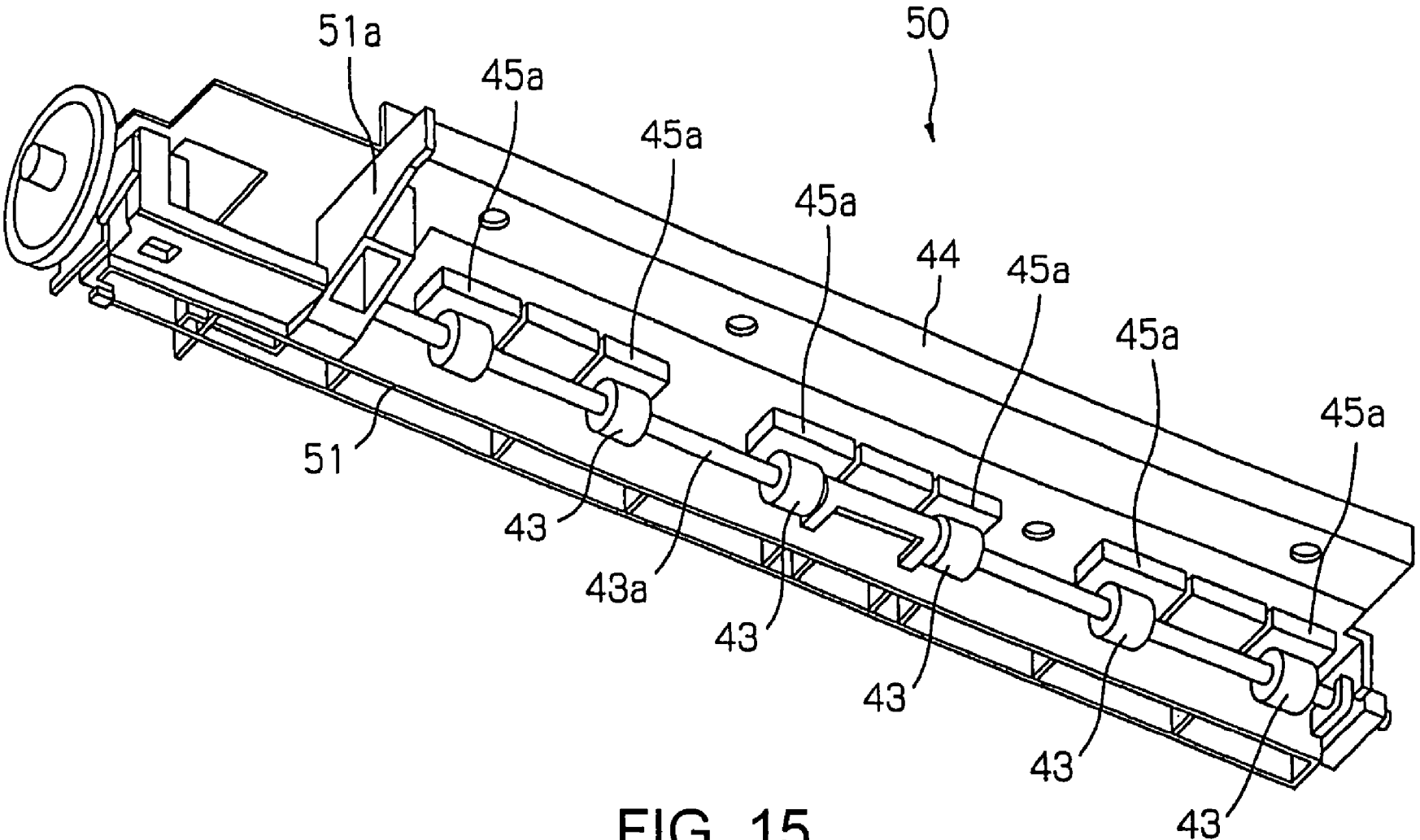
FIG. 15 is a perspective view of the unit including the second guiding member and the discharge frame.
Figure 16:
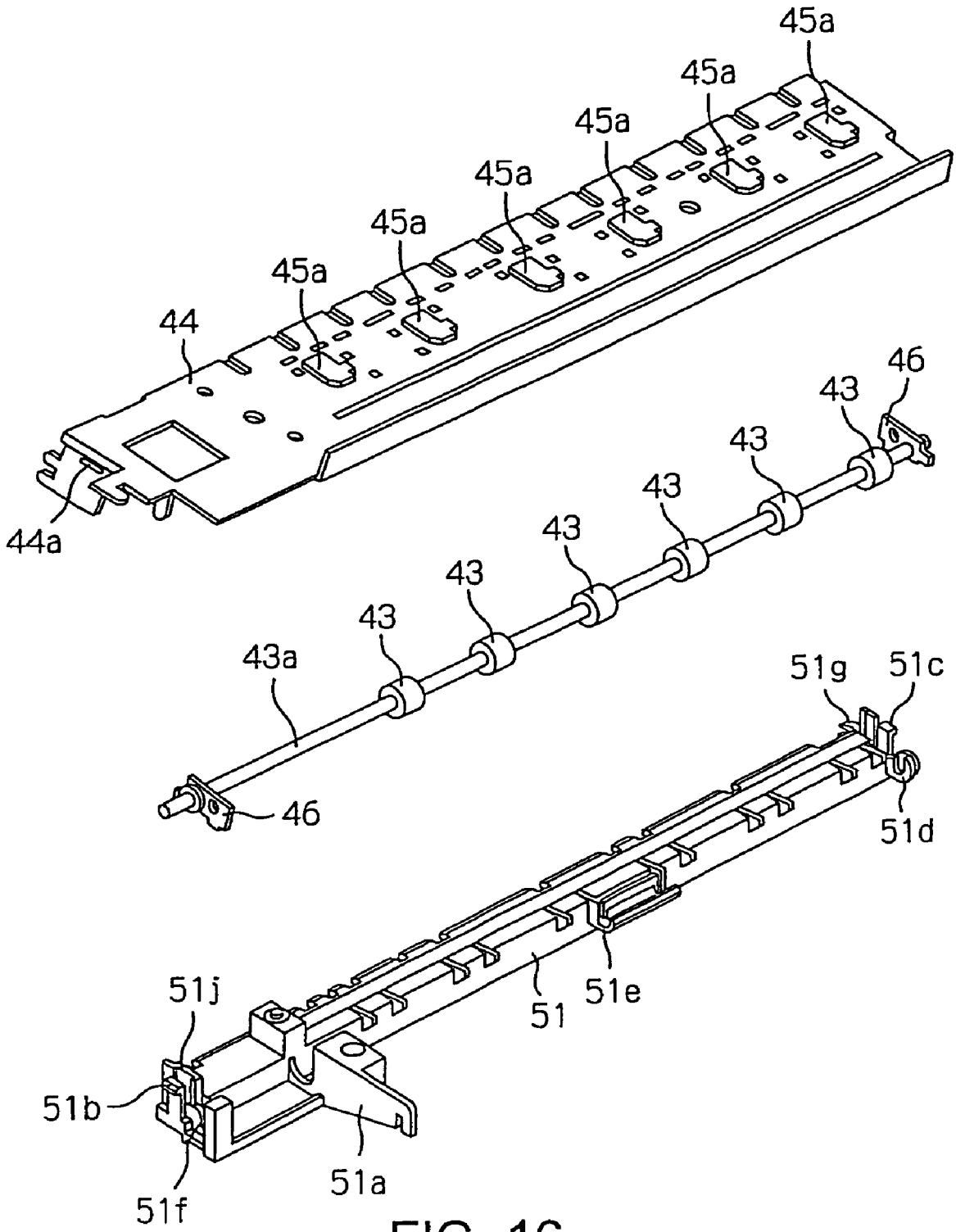
FIG. 16 is a disassembled perspective view of the unit including the second guiding member and the discharge frame.
Figure 17:
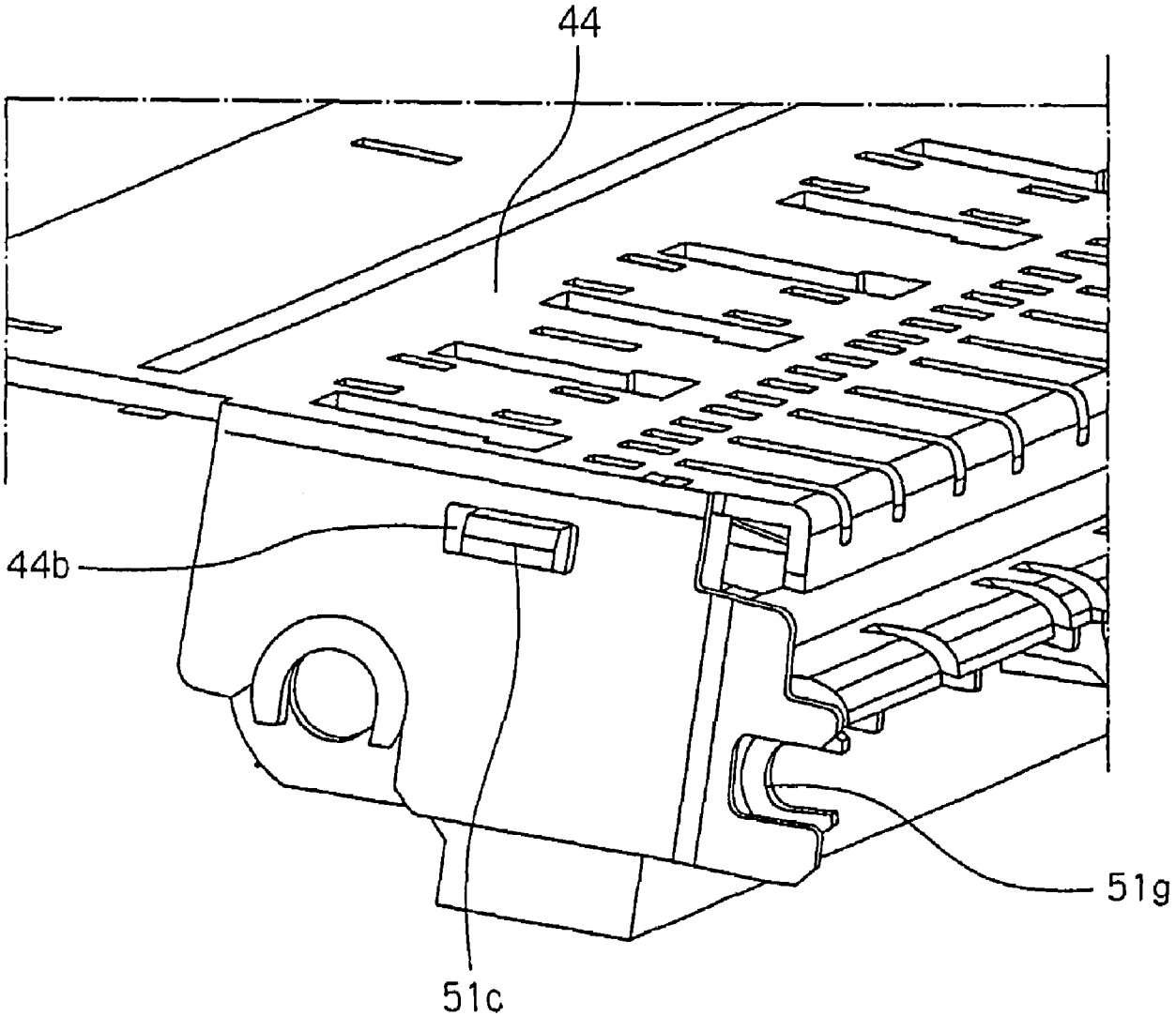
FIG. 17 is a partly enlarged view of the unit including the second guiding member and the discharge frame.
Figure 18:
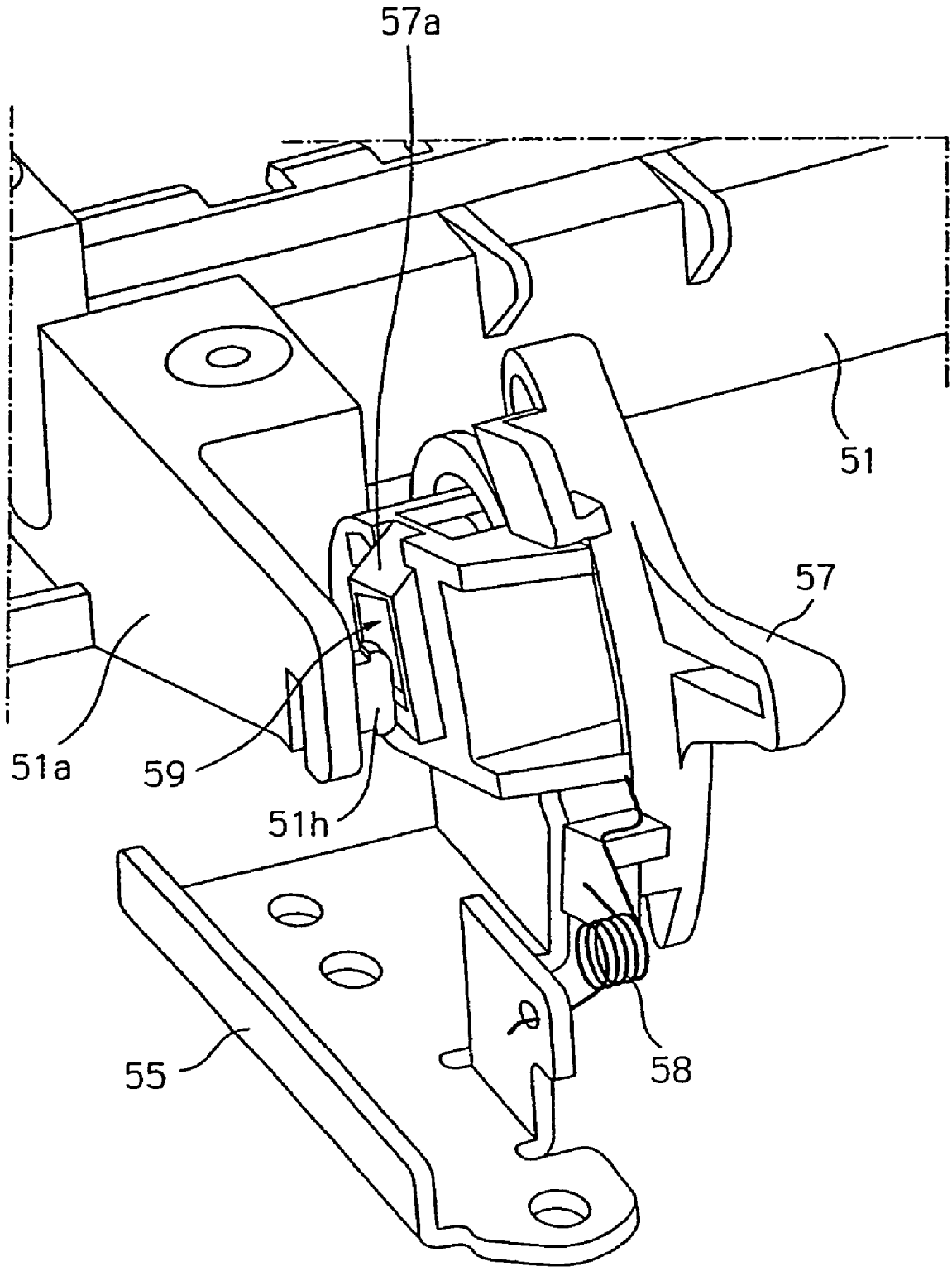
FIG. 18 is a perspective view of an engaging unit of an operation lever and the first guiding member.
Figure 19A:
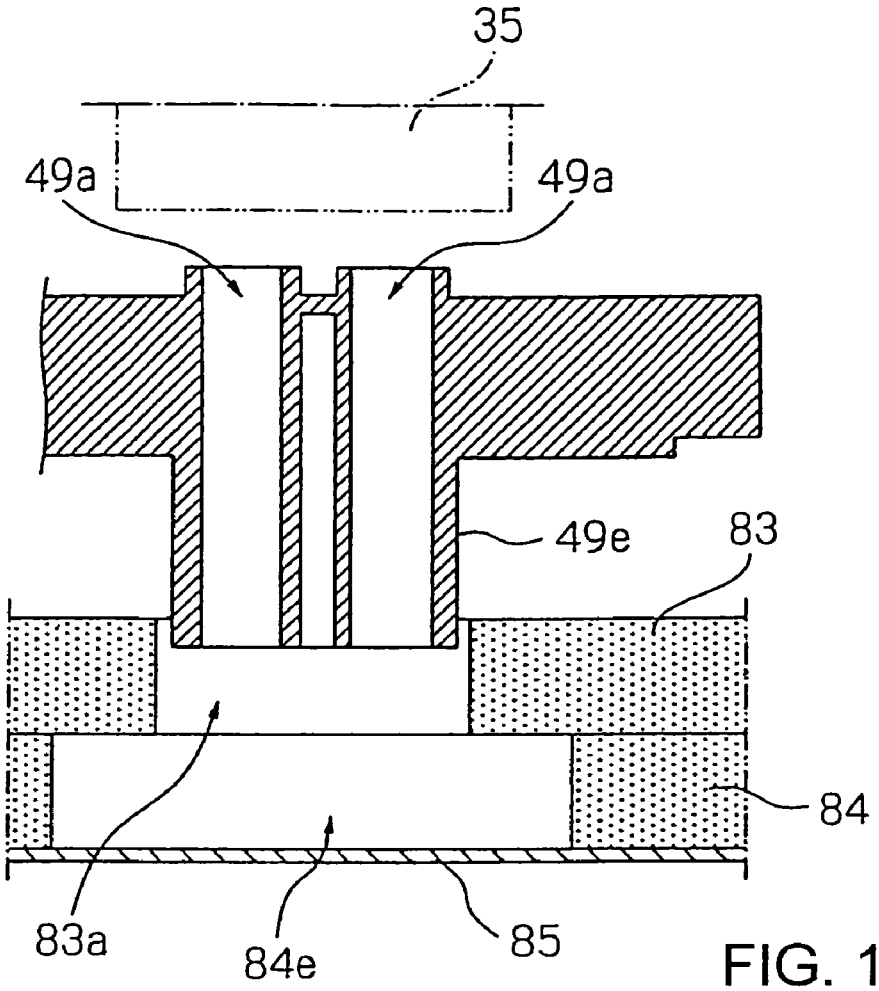
FIGS. 19A and 19B are across-section view and a plane view of an ink waste hole.
Figure 19B:
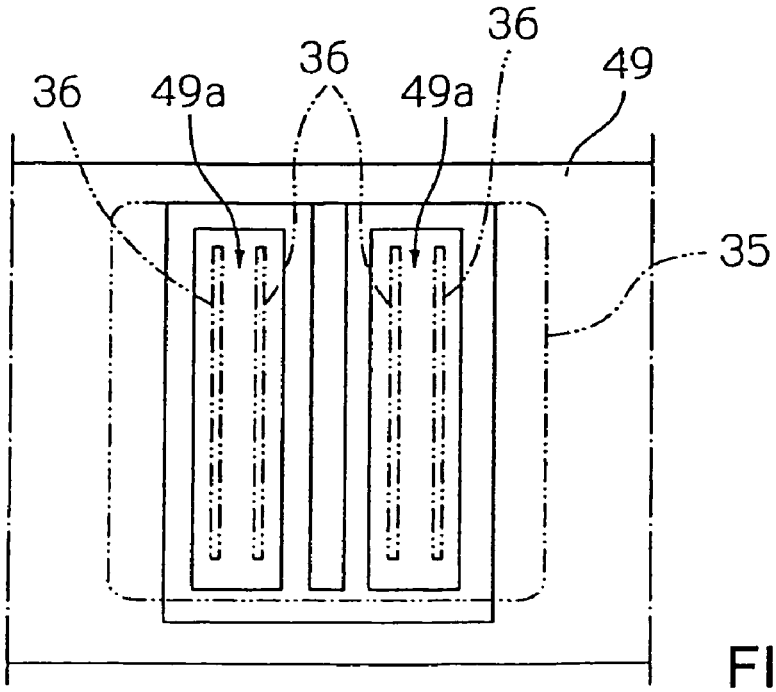

Here, FIG. 11 is a perspective view showing that the first guiding member 49, the second guiding member 51, the discharge frame 44, and the driving discharge roller rotation axis 43*a* are installed on a main frame 2. FIG. 12 is a perspective view showing that the first guiding member 49 is installed on the main frame 2. FIG. 13 is a perspective view of the first guiding member 49. FIGS. 14 and 15 is perspective views of a unit 50 including the second guiding member 51, the driven discharge roller supporting frame 44, and the driving discharge roller 43*a*. FIG. 16 is a disassembled perspective view of the unit 50. FIG. 17 is a partly enlarged view of the unit 50. FIG. 18 is a perspective view of an engaging unit of the operation lever 57 and the first guiding member 49. FIG. 19 is a partly enlarged view of an ink waste hole 49*a*. FIGS. 19A and 19B are a cross-section view and a plane view, respectively.

As described with regard to FIGS. 2 and 3, the platen unit 40 is formed by connecting the first guiding member 49 and the second guiding member 51. In other words, the platen unit 40 consists of the first guiding member 49 of the upstream side and the second guiding member 51 of the downstream side and each of the first guiding member 49 and the second guiding member 51 faces the transfer path of the recording medium P from the side and is provided to be able to swing. Thus, it is possible to adjust the medium gap PG. Moreover, according to the present embodiment, the first and second guiding members 49 and 51 are made of resin.

Then, when the operation lever 57 is moved downward as shown in FIG. 4, the second guiding member 51 is rotated about the driving discharge roller rotation axis 43*a* with the discharge frame 44 in the clockwise direction of FIG. 4. Moreover, when the operation lever 57 is moved upward as shown in FIG. 5, the second guiding member 51 is rotated about the driving discharge roller rotation axis 43*a* with the discharge frame 44 in the counterclockwise direction.

The end of the upstream side of the first guiding member 49 in the transfer direction is rotatably connected to the main frame 2 (see FIG. 11). Therefore, when the second guiding member 51 rotates from the position shown in FIG. 4 in the counterclockwise direction, the first guiding member 49 rotates about the axis 29*a* of the driving transfer roller 29 in the clockwise direction of FIG. 4.

Moreover, when the operation lever 57 is moved down, the medium pressing roller 47 is moved to an upper position as shown in FIG. 2. When the operation lever 57 is moved up, the medium pressing roller 47 is moved to a lower position and presses down the recording medium as shown in FIG. 3.

As shown in FIG. 18, an inclined surface 57*a* is formed on the upside of the hole 59 formed in the operation lever 57. When the second guiding member 51 is connected to the first guiding member 49 installed on the main frame 2 (explained in detail in the following), the rotation end 51*a* is elastically deformed and thus the protrusion 51*h* goes over the inclined surface 57*a*. Consequently, the protrusion 51*h* is guided to the hole 59 by the inclined surface 57*a*.

In other words, the protrusion 51*h* of the rotation end 51*a* is formed to protrude in a longitudinal direction of the second guiding member 51 and engages with the hole 59 formed in the operation lever 57. Thus, the operation lever 57 and the second guiding member 51 are linked to move. Here, the inclined surface 57*a* for guiding the protrusion 51*h* to the hole 59 is formed on the upside of the hole 59 and the rotation end 51*a* is adapted to be elastically deformed in a projecting direction of the protrusion 51*h* (that is, a longitudinal direction of the second guiding member). Therefore, if the second guiding member 51 is moved downward perpendicularly from the upside of the operation lever 57, the protrusion 51*h* is guided to the hole 59 by the inclined surface 57*a* and they are engaged which is accompanied by the elastic deformation of the rotation end 51*a*. Thus, it is possible to simply engage the second guiding member 51 and the operation lever 57 by a simple operation of moving the second guiding member 51 downward from the upside of the operation lever 57 and assembling efficiency is improved.

In the following, it will be described how the first guiding member 49, the second guiding member 51, the discharge frame 44, and the driving discharge roller rotation axis 43*a* are to be installed on the main frame 2.

In FIG. 11, the reference numeral 2 indicates a main frame forming a body of the recording apparatus. The main frame 2 is made of metal to form a C-shape substantially viewed from the above and includes supporting units 2*a* and 2*b* formed to stand on the both sides of the second guiding member 51. Then, the first guiding member 49, the second guiding member 51, and the driving discharge roller 43*a* are supported by the supporting units 2*a* and 2*b*. Moreover, the reference numeral 50 in FIG. 11 indicates a unit which is one body formed by the second guiding member 51, the discharge frame 44, and the driving discharge roller rotation axis 43*a* (explained in detail later).

Then, as shown in FIG. 13, the first guiding member 49 includes axes 49*c* and 49*d* of a protrusion shape formed to protrude from the both ends of the upstream side thereof to the outside. Then, the axes 49*c* and 49*d* are fit into holes (not shown) formed in the supporting units 2*a* and 2*b* of the main frame, respectively, and thus, the first guiding member 49 is supported to face the transfer path of the recording medium P from the side and be able to swing as described above.

Moreover, ink waste holes 49*a* and 49*a* are formed on the end of the first guiding member 49 in the longitudinal direction. The ink waste holes 49*a* and 49*a* is formed to perforate vertically a pipe unit 49*e* as shown in FIG. 19A in detail and performs a function of receiving the ink drops ejected by flushing operation of the recording head 35. A waste ink tray 85 (the whole is not shown) is provided on the underside of the ink waste holes 49*a* and 49*a* and collects waste ink drops. Absorbing materials 83 and 84 for absorbing and holding the ink are provided inside the waste ink tray 85 as a plurality of layers (according to the present embodiment, two layers) are formed.

Here, one of the ink waste holes 49*a* takes charge of two nozzle aperture arrays 36 and the size of the ink waste hole 49*a* is sufficiently large in comparison with the nozzle aperture arrays 36 as shown in FIG. 19B. Therefore, it is hard to say that all the ink drops ejected from the recording head 36 are shot perpendicularly due to shift in shooting position. Moreover, according to the recording apparatus 1 of the present invention, the first guiding member 49 is formed to able to swing in order to adjust the medium gap PG. Therefore, the aperture of the ink waste hole 49*a* is sufficiently large.

With regard to the absorbing materials 83 and 84 provided in the waste ink tray 85, an aperture 83*a* is formed in the absorbing materials 83 of the upper layer. The pipe unit 49*e* in which the ink waste hole 49*a* is formed gets into the aperture 83*a*. Therefore, it is possible to prevent that the waste ink drops become mist and the mist diffuses from the lower side of the pipe unit 49*e* (the ink waste hole 49*a*) to the outside. Moreover, it is possible to prevent the inside of the apparatus from being stained. Moreover, an aperture 84*a* and a groove which is not shown and communicates with the aperture 84*a* are formed in the absorbing materials 84 of the lower layer. Thus, the ink drops fell into the waste ink tray 85 diffuse over the whole tray.

As shown in FIGS. 14, 15, and 16, it is possible to form the unit 50 by forming one body with the second guiding member 51, the driving discharge roller axis 43*a*, and the discharge frame 44. As shown in FIG. 16, protrusions 51*b* and 51*c* protruding to the outside are formed on both ends in the longitudinal direction of the second guiding member 51. A hole 44*a* into which the protrusion 51*b* is fitted and a hole (not shown) into which the protrusion 51*c* is fitted are formed in the discharge frame 44. Each protrusion is fitted into corresponding hole in a snap type as shown in FIG. 17 and thus it is possible to simply fit the protrusion into the hole (forming one body). Therefore, a fitting means for engaging the second guiding member 51 and the discharge frame 44 consists of the projections 51*b* and 51*c* and the hole 44*a* and the hole not shown into which the projections 51*b* and 51*c* are fitted, respectively.

In the mean time, axis receiving units 51*d*, 51*e*, and 51*f* are formed in the second guiding member 51 as a supporting unit. The driving discharge roller axis 43*a* is fitted into the axis receiving unit 51*d*, 51*e*, and 51*f* in a snap type.

The driving discharge roller axis 43*a* is rotatably supported by axis receiving units 2*c* and 2*d* formed in the main frame 2 (FIG. 12) via bush members 46 and 46 shown in FIG. 16. Thus, the driving discharge roller axis 43*a* rotates to discharge the medium to be printed. Therefore, the second guiding member 51 faces the transfer path of the medium to be printed from the side and rotates about the driving discharge roller axis 43*a* to adjust the medium gap PG by fitting the driving discharge roller axis 43*a* into the axis receiving units 51*d*, 51*e*, and 51*f*.

As described above, the driving discharge roller axis 43*a* is supported by the second guiding member 51 before being installed on the main frame 2 and is engaged with the discharge frame 44. Thus, it is possible to form the unit.

The first guiding member 49 and the second guiding member 51 may be connected by the snap type connecting means. In other words, axes 49*b* and 49*c* forming the connecting means are formed on both ends in the longitudinal direction of the first guiding member 49 as shown in FIG. 13. Axis receiving unit 51*g* and 51*i* are formed on positions of the second guiding member 51 corresponding to the axes 49*b* and 49*c* forming the connecting means, respectively, as shown in FIG. 16. Then, the first and second guiding members 49 and 51 can be connected in a snap type and swing with respect to each other by fitting the axes 49*b* and 49*c* into the axis receiving units 51*j* and 51*g*, respectively.

Therefore, when the first guiding member 49, the second guiding member 51, the driving discharge roller axis 43*a* and the discharge frame 44 are installed on the main frame 2, the second guiding member 51 included in the unit 50 is connected to the first guiding member installed on the main frame 2 in a snap type while they forms the unit 50 and the first guiding member 49 is installed on the main frame 2. By this, the second guiding member 51 and the discharge frame 44 are supported by the main frame 2 via the first guiding member 49. Moreover, at this time, the driving discharge roller axis 43*a* is fit into the axis receiving units 2*c* and 2*d* formed on the main frame 2 via the bush member 46. By this, the driving discharge roller axis 43*a* is supported by the main frame 2. Therefore, the unit 50 is supported by the main frame 2.

Now, the result achieved by the above described configuration is described in detail. The recording apparatus 1 includes the recording head 35, the platen unit 40 as the guiding member for regulating a distance between the recording medium P and the recording head 35, the platen unit being formed to be elongated in the main scanning direction of the recording head and provided on the position facing with the recording head 35, the driving discharge roller 43 for rotating in contact with and discharging the recording medium P on which recording is performed, the driving discharge roller 43 being provided on the driving discharge roller axis 43*a* elongated in the main scanning direction of the recording head 35 on a downstream side of the recording head 35, the driven discharge roller 45 for rotating in contact with the driving discharge roller 43, the discharge frame 44 for supporting the driven discharge roller 45, the discharge frame 44 being formed to be elongated in the main scanning direction of the recording head, and a main frame 2 for supporting the platen unit 40, the discharge frame 44 and the rotation axis 43*a* of the driving discharge roller 43. According to the recording apparatus 1, the platen unit 40 includes the first guiding member 49 in the upstream side and the second guiding member 51 in the downstream side, and the first and second guiding members 49 and 51 are configured to be connected with each other by a snap type connecting means. Moreover, the second guiding member 51 and the discharge frame 44 are integrated to form the unit 50, and the unit 50 is adapted to be installed on the main frame 2 by connecting the second guiding member 51 to the first guiding member 49 supported by the main frame 2.

Therefore, at first, it is possible to increase an assembling efficiency since the unit 50 can be easily installed on the main frame 2 after the unit 50 is configured by forming one body with the second guiding member 51, the discharge frame 44 and the rotation axis 43*a* of the driving discharge roller 43.

Moreover, it is enough to connect the second guiding member 51 to the first guiding member 49 in a snap type when the unit 50 is installed on the main frame 2 since the first and second guiding members 49 and 51 are configured to be connected by the snap type connecting means. Therefore, it is possible to simply install the unit 50 on the main frame 2 without using means such as a screw. Moreover, it is required to install the rotation axis 43*a* on the main frame 2, but it is enough to fit it into the axis receiving units 2*c* and 2*d* formed on the main frame 2 via the above described bush member 46.

Moreover, the first guiding member 49 is directly installed on the main frame 2, but the second guiding member 51 is installed via the first guiding member 49. Therefore, a large stress is not generated even when the second guiding member 51 is deformed due to high heat since the second guiding member 51 is not directly restricted by the main frame 2. Therefore, it is possible to maintain high recording quality by preventing or decreasing variation in medium gap PG since it is possible to decrease the risk of stress deformation for the whole platen unit 50.

Additionally, it is possible to prevent deformation of the discharge frame 44 since the discharge frame 44 is also installed on the main frame 2 via the first guiding unit 49, and thus to prevent the recording quality from decreasing, such as generation of notched marks, since it is possible to maintain the position of the driven discharge roller 45 uniformly for the long time.

Moreover, it is possible to increase maintenance efficiency of the recording apparatus 1 since it only needs to decouple the first and second guiding members 49 and 51 in case the unit 50 needs to be separated from the recording apparatus 1. Especially, the members may be stained by the ink mists since a waste ink tray is formed on a location away from the side end of the recording medium P between ribs 39*a* and 39*b* and 39*b* and 39*c* on the platen unit 40, in other words borderless recording can be performed, but it is easy to exchange the stained member since the unit 50 can be easily removed as described above. Thus, it is possible to provide a recording medium in consideration of environmental merits by increasing recycling and/or reusing convenience since it is enough to decouple the first and second guiding members 49 and 51 in case the unit 50 needs to be separated from the recording apparatus.

Moreover, it is possible to increase working efficiency when the rotation axis 43*a* of the driving discharge roller 43 is supported by the second guiding member 51 and installed on the main frame 2 since the rotation axis 43*a* of the driving discharge roller 43 forms one body of the unit 50 as a part of the unit 50 while the second guiding member 51 includes the axis receiving units 51*d*, 51*e* and 51*f* for supporting the rotation axis 43*a* of the driving discharge roller 43.

Although the liquid ejection apparatus of the present invention is described by way of an embodiment of a recording apparatus with a scanner, it is possible to apply the idea of the present invention to a liquid ejection apparatus including a carriage for supporting a liquid ejection head which performs liquid ejection on a medium and scans in a direction perpendicular to the medium transfer direction.

Although the invention has been described in its preferred form with a certain degree of particularity, obviously many changes and variations are possible therein. It is therefore to be understood that the present invention may be practiced than as specifically described herein without departing from scope and spirit thereof.

What is claimed is:

1. A liquid ejection apparatus comprising:

a liquid ejection head for ejecting liquid on a medium;

a guiding member for regulating a distance between the medium and said liquid ejection head, said guiding member being formed to be elongated in a main scanning direction of said liquid ejection head and provided on a position facing with said liquid ejection head;

a driving discharge roller for rotating in contact with and discharging the medium on which liquid ejection is performed, said driving discharge roller being provided on a driving discharge roller axis elongated in the main scanning direction of said liquid ejection head on a downstream side of said liquid ejection head;

a driven discharge roller for rotating in contact with said driving discharge roller;

a driven discharge roller supporting frame for supporting said driven discharge roller, said driven discharge roller supporting frame being formed to be elongated in the main scanning direction of said liquid ejection head; and a main frame for supporting a rotation axis of said driving discharge roller together with said guiding member and said driven discharge roller supporting frame, wherein said guiding member comprises a first guiding member provided on an upstream side of said liquid ejection head in a medium transfer direction, and a second guiding member provided on a downstream side of said liquid ejection head in the medium transfer direction, said second guiding member being able to be connected to said first guiding member with a snap type connecting unit, said second guiding member and said driven discharge roller supporting frame are integrated to form a unit, and said unit is adapted to be installed on said main frame by connecting said second guiding member to said first guiding member supported by said main frame.

2. A liquid ejection apparatus as claimed in claim 1, wherein said second guiding member and said driven discharge roller support frame are engaged with each other by a snap type fitting means in order to form said unit.

3. A liquid ejection apparatus as claimed in claim 1, wherein said second guiding member comprises a supporting unit for supporting the rotation axis of said driving discharge roller, and the rotation axis of said driving discharge roller is integrated with said unit to be a part of said unit.

4. A liquid ejection apparatus as claimed in claim 1, wherein the rotation axis of said driving discharge roller is formed to be supported by an axis receiving unit provided on said main frame via a bush member.

5. A liquid ejection apparatus as claimed in claim 1, wherein said first guiding member is adapted to swing around a swing axis provided on a upstream side of said connecting unit of said first and second guiding members, said second guiding member is adapted to swing around a swing axis provided on a downstream side of said connecting unit of said first and second guiding members, and a gap between the medium and said liquid ejection head is adjustable by swing operations of said first and second guiding members.

6. A liquid ejection apparatus as claimed in claim 5, further comprising a rotatable operation lever for performing the swing operation of said second guiding member, said operation lever being provided on a downstream side of said second guiding member, wherein said second guiding member comprises a rotation end which is formed to be elongated in a direction toward said operation lever and to be able to deform elastically in a longitudinal direction of said second guiding member, said operation lever and said rotation end are adapted to operate in association with each other by engaging a protrusion formed on said rotation end to protrude with a longitudinal direction of said second guiding member into a hole formed on said operation lever, and an inclined surface for guiding the protrusion into the hole is formed on an upside of the hole.

* * * * *